US007056396B2

(12) United States Patent
Oishi

(10) Patent No.: US 7,056,396 B2
(45) Date of Patent: Jun. 6, 2006

(54) COPPER/ZINC ALLOYS HAVING LOW LEVELS OF LEAD AND GOOD MACHINABILITY

(75) Inventor: Keiichiro Oishi, Sakai (JP)

(73) Assignee: Sambo Copper Alloy Co., Ltd., Osaka (JP)

( * ) Notice: Subject to any disclaimer, the term of this patent is extended or adjusted under 35 U.S.C. 154(b) by 181 days.

(21) Appl. No.: 09/983,029

(22) Filed: Oct. 22, 2001

(65) Prior Publication Data

US 2002/0159912 A1 Oct. 31, 2002

Related U.S. Application Data

(63) Continuation-in-part of application No. 09/403,834, filed as application No. PCT/JP98/05156 on Nov. 16, 1998, now abandoned.

(30) Foreign Application Priority Data

Oct. 9, 1998 (JP) ..... 10-287921

(51) Int. Cl.
*C22C 9/04* (2006.01)
C22C 1/08

(52) U.S. Cl. ..... 148/434; 148/686; 420/477; 420/478; 420/479; 420/481; 420/482; 420/484

(58) Field of Classification Search ..... 148/434, 148/686; 420/477–479, 481–482, 484
See application file for complete search history.

(56) References Cited

U.S. PATENT DOCUMENTS

| | | | | |
|---|---|---|---|---|
| 1,954,003 | A | | 4/1934 | Vaders |
| 4,055,445 | A | | 10/1977 | Pops |
| 4,676,848 | A | | 6/1987 | Ruchel |
| 5,582,281 | A | * | 12/1996 | Nakashima et al. ... 192/107 M |
| 5,658,401 | A | | 8/1997 | Gaag |
| 5,942,056 | A | * | 8/1999 | Singh ..... 148/434 |

FOREIGN PATENT DOCUMENTS

| | | | |
|---|---|---|---|
| CA | 1243226 | | 10/1988 |
| CH | 148824 | | 10/1931 |
| DE | 1558470 | | 3/1970 |
| DE | 3427740 | | 2/1986 |
| DE | 41 39 063 A1 | | 6/1993 |
| GB | 359570 | | 10/1931 |
| GB | 1443090 | | 7/1976 |
| JP | 49-9296 | | 1/1974 |
| JP | 56-9347 | | 1/1981 |
| JP | 56-96040 | | 8/1981 |
| JP | 61-133357 | | 6/1986 |
| JP | 62274036 | * | 11/1987 |
| JP | 62-274036 | | 11/1987 |
| JP | 62-297429 | | 12/1987 |
| JP | 62297429 | * | 12/1987 |
| JP | 03-68732 | | 3/1991 |
| JP | 3-68733 | | 3/1991 |
| JP | 03068733 | * | 3/1991 |
| JP | 3-110042 | | 5/1991 |
| JP | 04-224645 | | 8/1992 |

(Continued)

OTHER PUBLICATIONS

Japanese Office Action for Application No. H10–287921, mailed Jan. 22, 2002.

(Continued)

*Primary Examiner*—Sikyin Ip
(74) *Attorney, Agent, or Firm*—Griffin & Szipl, P.C.

(57) ABSTRACT

The free-cutting copper alloy according to the present invention contains a greatly reduced amount of lead in comparison with conventional free-cutting copper alloys, but provides industrially satisfactory machinability. The free-cutting alloys comprise 69 to 79 percent, by weight, of copper, 2.0 to 4.0 percent, by weight, of silicon, 0.02 to 0.4, by weight, of lead, and the remaining percent, by weight, of zinc.

14 Claims, 1 Drawing Sheet

FOREIGN PATENT DOCUMENTS

| | | | |
|---|---|---|---|
| JP | 4-246141 | | 9/1992 |
| JP | 7-310133 | | 11/1995 |
| JP | 9-143598 | | 6/1997 |
| JP | 10-081926 | | 3/1998 |
| JP | 10-287921 | A2 | 10/1998 |
| JP | 2000-119775 | A2 | 4/2000 |
| JP | 2002-030364 | | 1/2002 |
| WO | WO 94/01591 | | 1/1994 |
| WO | 9810105 | * | 3/1998 |

OTHER PUBLICATIONS

Japanese Office Action for Application No. H10–288590, mailed Jan. 29, 2002.
Protest mailed from the Japanese Patent Office on Jan. 16, 2002 for Application No. H10–288590.
Standard Specification for Copper–Zinc–Silicon Alloy Rod, Annual Book of ASTM Standards, 1993, pp. 536–538, vol. 02.01: Copper and Copper Alloys.
Copper Alloy No. C69400 (Silicon Red Brass), Standards Handbook, 1985, p. 143, 8th Edition, Copper Development Assn., New York.
Canadian Office Action for Application No. 2,303,512, mailed on Aug. 27, 2004.
European Office Action for Applications No. 98 953 070.4, mailed on Oct. 6, 2003.
Mannheim, R. et al. "Silicon brass: an alternative for lead–free faucets and fittings." 1998. Second Annual Conference on Metallurgic and Materials Technology. Sao Paulo. STN Database No. 131.246354.
Partial European Search Report for Application No. 98 95 3071, dated Sep. 23, 2002.
Mannheim, R. et al. "Silicon brass: an alternative for lead–free faucets and fittings", English Abstract, 1998.
"ASM Specialty Handbook: Copper and Copper Alloys," ASM International, 2001, p. 545, Example C87800.
Patent Abstracts of Japan, English Abstract for JP 61–133357, 1986.
Patent Abstracts of Japan, English Abstract for JP 09–143598, 1997.
Patent Abstracts of Japan, English Abstract for JP 10–081926, 1998.
European Search Report for European Application No. EP 04 07 7560, dated Nov. 18, 2004.
European Search Report for European Application No. EP 04 07 7561, dated Dec. 12, 2004.

* cited by examiner

COPPER/ZINC ALLOYS HAVING LOW LEVELS OF LEAD AND GOOD MACHINABILITY

This application is a continuation-in-part of U.S. patent application Ser. No. 09/403,834, filed Oct. 27, 1999, now abandoned, which is a 371 of PCT/JP98/05156 filed Nov 16, 1998, the entire disclosure of which is incorporated herein by reference, which application claims priority from Japanese Application No. 10-287921, filed Oct. 9, 1998, the entire disclosure of which is incorporated herein by reference.

BACKGROUND OF THE INVENTION

1. Field of the Invention

The present invention relates to free-cutting copper alloys.

2. Prior Art

Among the copper alloys with a good machinability are bronze alloys such as that having the JIS designation H5111 BC6 and brass alloys such as those having the JIS designations H3250-C3604 and C3771. Those alloys are enhanced in machinability with the addition of 1.0 to 6.0 percent, by weight, of lead so as to give industrially satisfactory results as easy-to-work copper alloys. Because of their excellent machinability, those lead-containing copper alloys have been an important basic material for a variety of articles such as city water faucets and water supply/drainage metal fittings and valves.

In those conventional free-cutting copper alloys, lead does not form a solid solution in the matrix but disperses in granular form, thereby improving the machinability of those alloys. To produce the desired results, lead has to be added in as much as 2.0 or more percent by weight. If the addition of lead is less than 1.0 percent by weight, chippings will be spiral in form, as (D) in FIG. 1. Spiral chippings cause various troubles such as, for example, tangling with the tool. If, on the other hand, the content of lead is 1.0 or more percent by weight and not larger than 2.0 percent by weight, the cut surface will be rough, though that will produce some results such as reduction of cutting resistance. It is usual, therefore, that lead is added to an extent of not less than 2.0 percent by weight. Some expanded copper alloys in which a high degree of cutting property is required are mixed with some 3.0 or more percent by weight of lead. Further, some bronze castings have a lead content of as much as some 5.0 percent, by weight. The alloy having the JIS designation H 5111 BC6, for example, contains some 5.0 percent by weight of lead.

However, the application of those lead-mixed alloys has been greatly limited in recent years, because lead contained therein is harmful to humans as an environment pollutant. That is, the lead-containing alloys pose a threat to human health and environmental hygiene because lead finds its way into metallic vapor that generates in the steps of processing those alloys at high temperatures such as melting and casting. There is also a danger that lead contained in the water system metal fittings, valves, and so on made of those alloys will dissolve out into drinking water.

For these reasons, the United States and other advanced nations have been moving in recent years to tighten the standards for lead-containing copper alloys to drastically limit the permissible level of lead in copper alloys. In Japan, too, the use of lead-containing alloys has been increasingly restricted, and there has been a growing call for the development of free-cutting copper alloys with a low lead content.

SUMMARY OF THE INVENTION

It is an object of the present invention to provide a free-cutting copper alloy that contains an extremely small amount (0.02 to 0.4 percent by weight) of lead as a machinability-improving element, yet which is quite excellent in machinability, that can be used as safe substitute for the conventional easy-to-cut copper alloys that have a large lead content, and that presents no environmental hygienic problems while permitting the recycling of chippings, thus providing a timely answer to the mounting call for the restriction of lead-containing products.

It is an another object of the present invention to provide a free-cutting copper alloy that has high corrosion resistance coupled with excellent machinability and is suitable as basic material for cutting works, forgings, castings and others, thus having a very high practical value. The cutting works, forgings, castings, and so on, including city water faucets, water supply/drainage metal fittings, valves, stems, hot water supply pipe fittings, shaft and heat exchanger parts.

It is yet another object of the present invention to provide a free-cutting copper alloy, with a high strength and wear resistance coupled with an easy-to-cut property, that is suitable as basic material for the manufacture of cutting works, forgings, castings, and other uses requiring high strength and wear resistance such as, for example, bearings, bolts, nuts, bushes, gears, sewing machine parts, and hydraulic system parts, and which therefore is of great practical value.

It is a further object of the present invention to provide a free-cutting copper alloy with an excellent high-temperature oxidation resistance combined with an easy-to-cut property, which is suitable as basic material for the manufacture of cutting works, forgings, castings, and other uses where a high thermal oxidation resistance is essential, e.g. nozzles for kerosene oil and gas heaters, burner heads, and gas nozzles for hot-water dispensers, and which therefore has great practical value.

It is a further object of the present invention to provide a free-cutting copper alloy with excellent machinability and high impact resistance, which is suitable as basic material for the manufacture of products that need to be made of impact resistant material because they undergo a caulking process after a cutting process, such as tube connectors called "nipples," metal hinges for furnature, automobile sensor parts, and the like.

The objects of the present inventions are achieved by provision of the following copper alloys:

A free-cutting copper alloy with an excellent easy-to-cut feature which is composed of 69 to 79 percent, by weight, of copper, 2.0 to 4.0 percent, by weight, of silicon, 0.02 to 0.4 percent, by weight, of lead and the remaining percent, by weight, of zinc, wherein the percent by weight of copper and silicon in the copper alloy satisfy the relationship $60 \leqq X-3Y \leqq 70$, wherein X is the percent, by weight, of copper, and Y is the percent, by weight, of silicon; and the copper alloy has a metal construction comprising multiple phases integrated to form a composite phase, wherein the composite phase is an $\alpha$ phase matrix having a total phase area comprising not more than 5% of $\beta$ phase, and 5–70% of the total phase area is provided by at least one phase selected from the group consisting of a $\gamma$ phase, a $\kappa$ phase, and a $\mu$ phase. For purpose of simplicity, this copper alloy will be hereinafter called the "first invention alloy."

Lead does not form a solid solution in the matrix but instead disperses in granular form to improve machinability.

Silicon improves the easy-to-cut property by producing a gamma phase (in some cases, a kappa phase) in the structure of metal. Silicon and lead are the same in that they are effective in improving machinability, though they are quite different in their contribution to other properties of the alloy. On the basis of that recognition, silicon is added to the first invention alloy so as to bring about a high level of machinability meeting industrial requirements while making it possible to greatly reduce the lead content. That is, the first invention alloy is improved in machinability through formation of a gamma phase with the addition of silicon.

The addition of less than 2.0 percent by weight of silicon cannot form a gamma phase sufficient enough to secure industrially satisfactory machinability. With an increase in the addition of silicon, machinability improves. But with the addition of more than 4.0 percent by weight of silicon, machinability will not go up in proportion. The problem is, however, that silicon is high in melting point and low in specific gravity and also liable to oxidize. If unmixed silicon is fed into the furnace in the melting step, silicon will float on the molten metal and is oxidized into oxides of silicon (silicon oxide), hampering the production of a silicon-containing copper alloy. In producing the ingot of silicon-containing copper alloy, therefore, silicon is usually added in the form of a Cu—Si alloy, which boosts the production cost. Due also to the cost of making the alloy, it is not desirable to add silicon in a quantity exceeding the saturation point or plateau of machinability improvement, that is, 4.0 percent by weight. An experiment showed that when silicon is added in the amount of 2.0 to 4.0 percent by weight, it is desirable to hold the content of copper at 69 to 79 percent by weight in consideration of its relation to the content of zinc in order to maintain the intrinsic properties of the Cu—Zn alloy. For this reason, the first invention alloy is composed of 69 to 79 percent by weight of copper and 2.0 to 4.0 percent by weight of silicon, respectively. The addition of silicon improves not only the machinability but also the flow of the molten metal in casting, strength, wear resistance, resistance to stress corrosion cracking, and high-temperature oxidation resistance. However, these characteristics are not seen unless the percent by weight of copper and silicon in the first invention alloy satisfies the relationship $60 \leqq X-3Y \leqq 70$, wherein X is the percent, by weight, of copper and Y is the percent, by weight of silicon. Also, the ductility and de-zinc-ing corrosion resistance will be improved to some extent.

The addition of lead is set at 0.02 to 0.4 percent by weight for this reason. In the first invention alloy, a sufficient level of machinability is obtained by adding silicon that has the aforesaid effect even if the addition of lead is reduced. Yet, lead has to be added in an amount not smaller than 0.02 percent by weight if the alloy is to be superior to the conventional free-cutting copper alloy in machinability, while the addition of lead in an amount exceeding 0.4 percent by weight would have adverse effect, resulting in a rough surface condition, poor hot workability such as poor forging behavior, and low cold ductility. Meanwhile, it is expected that such a small content of not higher than 0.4 percent by weight will be able to clear the lead-related regulations however strictly they are to be stipulated in the advanced nations including Japan in the future. For that reason, the addition range of lead is set at 0.02 to 0.4 percent by weight in the first and also second to eleventh invention alloys which will be described later.

Another embodiment of the present invention is a free-cutting copper alloy also with an excellent easy-to-cut feature which is composed of 69 to 79 percent, by weight, of copper; 2.0 to 4.0 percent, by weight, of silicon; 0.02 to 0.4 percent, by weight, of lead; one additional element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc, wherein the percent by weight of copper and silicon in the copper alloy satisfy the relationship $60 \leqq X-3Y \leqq 70$, wherein X is the percent, by weight, of copper, and Y is the percent, by weight, of silicon; and the copper alloy has a metal construction comprising multiple phases integrated to form a composite phase, wherein the composite phase is an $\alpha$ phase matrix having a total phase area comprising not more than 5% of $\beta$ phase, and 5–70% of the total phase area is provided by at least one phase selected from the group consisting of a $\gamma$ phase, a $\kappa$ phase, and a $\mu$ phase. This second copper alloy will be hereinafter called the "second invention alloy."

That is, the second invention alloy is composed of the first invention alloy and, in addition, one element selected from among 0.02 to 0.4 percent, by weight, of bismuth, 0.02 to 0.4 percent, by weight, of tellurium, and 0.02 to 0.4 percent, by weight, of selenium.

Bismuth, tellurium, and selenium, as with lead, do not form a solid solution with the matrix but disperse in granular form to enhance machinability. That makes up for the reduction of the lead content. The addition of any one of those elements along with silicon and lead could further improve the machinability beyond the level obtained from the addition of silicon and lead. From this finding, the second invention alloy was developed, in which one element selected from among bismuth, tellurium, and selenium is mixed. The addition of bismuth, tellurium, or selenium as well as silicon and lead can make the copper alloy so machinable that complicated forms can be freely cut out at a high speed. But no improvement in machinability can be realized from the addition of bismuth, tellurium, or selenium in an amount of less than 0.02 percent by weight. However, those elements are expensive as compared with copper. Even if the addition exceeds 0.4 percent by weight, the proportional improvement in machinability is so small that addition beyond that level does not pay off economically. What is more, if the addition is more than 0.4 percent by weight, the alloy will deteriorate in hot workability such as forgeability and cold workability such as ductility. While there might be a concern that heavy metals like bismuth would cause a problem similar to that of lead, a very small addition of less than 0.4 percent by weight is negligible and would present no particular problems. From those considerations, the second invention alloy is prepared with the addition of bismuth, tellurium, or selenium kept to 0.02 to 0.4 percent by weight. In this regard, it is desired to keep the combined content of lead and bismuth, tellurium, or selenium to not higher than 0.4 percent by weight. That is because if the combined content exceeds 0.4 percent by weight, if slightly, then there will begin a deterioration in hot workability and cold ductility and also there is fear that the form of chippings will change from (B) to (A) in FIG. 1. But the addition of bismuth, tellurium or selenium, which improves the machinability of the copper alloy though a mechanism different from that of silicon as mentioned above, would not affect the proper contents of copper and silicon. For this reason, the contents of copper and silicon in the second invention alloy are set at the same level as those in the first invention alloy.

Another embodiment of the present invention is a free-cutting copper alloy, also with an excellent easy-to-cut feature, which is composed of 70 to 80 percent, by weight, of copper; 1.8 to 3.5 percent, by weight, of silicon; 0.02 to 0.4 percent. by weight, of lead; at least one element selected from among 1.0 to 3.5 percent, by weight, of aluminum, and 0.02 to 0.25 percent, by weight, of phosphorus; and the remaining percent, by weight, of zinc, wherein the percent by weight of copper, silicon, aluminum and phosphorus in the copper alloy satisfy the relationship $60 \leqq X-3Y+aZ+bW \leqq 70$, wherein X is the percent, by weight, of copper, Y is the percent, by weight, of silicon, Z is the percent, by weight, of aluminum, W is the percent, by weight, of phosphorus, a is −2, and b is −3; and the copper alloy has a metal construction comprising multiple phases integrated to form a composite phase, wherein the composite phase is an α phase matrix having a total phase area comprising not more than 5% of β phase, and 5–70% of the total phase area is provided by at least one phase selected from the group consisting of a γ phase, a κ phase, and a μ phase. This third copper alloy will be hereinafter called the "third invention alloy."

Aluminum is effective in facilitating the formation of the gamma phase and works like silicon. That is, if aluminum is added, a gamma phase will be formed and this gamma phase improves the machinability of the Cu—Si—Zn alloy. Aluminum is also effective in improving the strength, wear resistance, and high-temperature oxidation resistance as well as the machinability of the Cu—Si—Zn alloy. Aluminum also helps keep down the specific gravity. If the machinability is to be improved at all, aluminum will have to be added in an amount of at least 1.0 percent by weight. But the addition of more than 3.5 percent by weight could not produce proportional results. Instead, adding more aluminum in excess of 3.5 percent by weight lowers the ductility of the metal alloy without contributing further to the machinability.

As to phosphorus, it has no property of forming the gamma phase as does aluminum. But phosphorus works to uniformly disperse and distribute the gamma phase formed as a result of the addition of silicon alone or with aluminum. That way, the machinability improvement through the formation of gamma phase is further enhanced. In addition to dispersing the gamma phase, phosphorus helps refine the crystal grains in the alpha phase in the matrix, improving hot workability and also strength and resistance to stress corrosion cracking. Furthermore, phosphorus substantially increases the flow of molten metal in casting. To produce such results, phosphorus will have to be added in an amount not smaller than 0.02 percent by weight. But if the addition exceeds 0.25 percent by weight, no proportional effect will be obtained. Instead, there would be a decrease in hot forging property and extrudability.

In consideration of those observations, the third invention alloy is improved in machinability by adding to the Cu—Si—Pb—Zn alloy (first invention alloy) at least one additional element selected from among 1.0 to 3.5 percent, by weight, of aluminum, and 0.02 to 0.25 percent, by weight, of phosphorus.

Aluminum and phosphorus act to improve machinability by forming a gamma phase or dispersing that phase, and work closely with silicon in promoting the improvement in machinability through the gamma phase. In the third invention alloy to which silicon is added along with aluminum, or phosphorus, thus the addition of silicon is smaller than that in the second invention alloy to which is added bismuth, tellurium, or selenium, which replaces silicon of the first invention in improving machinability. That is, those elements bismuth, tellurium, and selenium contribute to improving the machinability, not acting on the gamma phase but dispersing in the form of grains in the matrix. Even if the addition of silicon is less than 2.0 percent by weight, silicon along with aluminum, or phosphorus will be able to enhance the machinability to an industrially satisfactory level as long as the percentage of silicon is 1.8 or more percent by weight. But even if the addition of silicon is not larger than 4.0 percent by weight, adding aluminum, or phosphorus, together with silicon will saturate the effect of silicon in improving the machinability, when the silicon content exceeds 3.5 percent by weight. For this reason, the addition of silicon is set at 1.8 to 3.5 percent by weight in the third invention alloy. Also, in consideration of the addition amount of silicon and also the addition of aluminum, or phosphorus, the content range of copper in this third invention alloy is slightly raised from the level in the second invention alloy and copper is properly set at 70 to 80 percent by weight.

A free-cutting copper alloy also with an excellent easy-to-cut feature which is composed of 70 to 80 percent, by weight, of copper; 1.8 to 3.5 percent, by weight, of silicon; 0.02 to 0.4 percent, by weight, of lead; at least one element selected from among 1.0 to 3.5 percent, by weight, of aluminum, and 0.02 to 0.25 percent, by weight, of phosphorus; one element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc, wherein the percent by weight of copper, silicon, aluminum and phosphorus in the copper alloy satisfy the relationship $60 \leqq X-3Y+aZ+bW \leqq 70$, wherein X is the percent, by weight, of copper, Y is the percent, by weight, of silicon, Z is the percent, by weight, of aluminum, W is the percent, by weight, of phosphorus, a is −2, and b is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase. This fourth copper alloy will be hereinafter called the "fourth invention alloy."

The fourth invention alloy has any one selected from among 0.02 to 0.4 percent, by weight, of bismuth, 0.02 to 0.4 percent, by weight, of tellurium, and 0.02 to 0.4 percent, by weight, of selenium in addition to the components in the third invention alloy. The grounds for mixing those additional elements and setting those amounts to be added are the same as given for the second invention alloy.

A free-cutting copper alloy with an excellent easy-to-cut feature and with a high corrosion resistance which is composed of 69 to 79 percent, by weight, of copper; 2.0 to 4.0 percent, by weight, of silicon; 0.02 to 0.4 percent, by weight, of lead; at least one element selected from among 0.3 to 3.5 percent, by weight, of tin, 0.02 to 0.25 percent, by weight, of phosphorus, 0.02 to 0.15 percent, by weight, of antimony, and 0.02 to 0.15 percent, by weight, of arsenic, and the remaining percent, by weight, of zinc, wherein the percent by weight of copper, silicon and phosphorous in the copper alloy satisfy the relationship $60 \leqq X-3Y+aZ \leqq 70$, wherein X is the percent, by weight, of copper, Y is the percent, by weight, of silicon, Z is the percent, by weight, of phosphorous, and a is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase. This fifth copper alloy will be hereinafter called the "fifth invention alloy."

The fifth invention alloy has, in addition to the first invention alloy, at least one element selected from among 0.02 to 0.25 percent, by weight, of phosphorus, 0.02 to 0.15 percent, by weight, of antimony, and 0.02 to 0.15 percent, by weight, of arsenic. As described above, phosphorus disperses the gamma phase uniformly and at the same time refines the crystal grains in the alpha phase in the matrix, thereby improving the machinability and also the corrosion resistance properties (de-zinc-ification corrosion resistance), forgeability, stress corrosion cracking resistance, and mechanical strength. The fifth invention alloy is thus improved in corrosion resistance and other properties through the action of phosphorus and in machinability mainly by adding silicon. The addition of phosphorus in a very small quantity, that is, 0.02 or more percent by weight, could produce beneficial results. But the addition in more than 0.25 percent by weight would not be so effective as hoped from the quantity added. Rather, that would reduce the hot forgeability and extrudability.

As with phosphorus, antimony and arsenic in a very small quantity—0.02 or more percent by weight—are effective in improving the de-zinc-ification corrosion resistance and other properties. But their addition exceeding 0.15 percent by weight would not produce results in proportion to the excess quantity added. Rather, it would affect the hot forgeability and extrudability as does phosphorus applied in excessive amounts.

Those observations indicate that the fifth invention alloy is improved in machinability and also corrosion resistance and other properties by adding at least one element selected from among phosphorus, antimony, and arsenic (which improve corrosion resistance) in quantities within the aforesaid limits in addition to the same quantities of copper and silicon as in the first invention copper alloy. In the fifth invention alloy, the additions of copper and silicon are set at 69 to 79 percent by weight and 2.0 to 4.0 percent by weight respectively—the same level as in the first invention alloy in which any other machinability improver than silicon and a small amount of lead is not added—because phosphorus works mainly as a corrosion resistance improver like antimony and arsenic.

A free-cutting copper alloy also with an excellent easy-to-cut feature and with a high corrosion resistance which is composed of 69 to 79 percent, by weight, of copper; 2.0 to 4.0 percent, by weight, of silicon; 0.02 to 0.4 percent, by weight, of lead; at least one element selected from among 0.02 to 0.25 percent, by weight, of phosphorus, 0.02 to 0.15 percent, by weight, of antimony, and 0.02 to 0.15 percent, by weight, of arsenic; one element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc, wherein the percent by weight of copper, silicon and phosphorous in the copper alloy satisfy the relationship $60 \leqq X-3Y+aZ \leqq 70$, wherein X is the percent, by weight, of copper, Y is the percent, by weight, of silicon, Z is the percent, by weight, of phosphorous, and a is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase. This sixth copper alloy will be herein after called the "sixth invention alloy."

The sixth invention alloy has any one element selected from among 0.02 to 0.4 percent, by weight, of bismuth, 0.02 to 0.4 percent, by weight, of tellurium, and 0.02 to 0.4 percent, by weight, of selenium in addition to the components in the fifth invention alloy. The machinability is improved by adding, in addition to silicon and lead, any one element selected from among bismuth, tellurium and selenium as in the second invention alloy and the corrosion resistance and other properties are raised by adding at least one selected from among phosphorus, antimony and arsenic as in the fifth invention alloy. Therefore, the additions of copper, silicon, bismuth, tellurium and selenium are set at the same levels as those in the second invention alloy, while the additions of phosphorus, antimony, and arsenic are adjusted to those in the fifth invention alloy.

A free-cutting copper alloy also with an excellent easy-to-cut feature and with an excellent high strength feature and high corrosion resistance which is composed of 62 to 78 percent, by weight, of copper; 2.5 to 4.5 percent, by weight, of silicon; 0.02 to 0.4 percent, by weight, of lead; at least one element selected from among 0.2 to 2.5 percent, by weight, of aluminum, and 0.02 to 0.25 percent, by weight, of phosphorus; and at least one element selected from among 0.7 to 3.5 percent, by weight, of manganese and 0.7 to 3.5 percent, by weight, of nickel; and the remaining percent, by weight, of zinc, wherein the percent by weight of copper, silicon, aluminum, phosphorous, manganese, and nickel in the copper alloy satisfy the relationship $60 \leqq X-3Y+aZ+bW+cV+dU \leqq 70$, wherein X is the percent, by weight, of copper, Y is the percent, by weight, of silicon, Z is the percent, by weight, of aluminum, W is the percent, by weight, of phosphorous, V is the percent, by weight, of manganese, U is the percent, by weight, of nickel, a is −2, b is −3, c is 2.5, and d is 2.5, and the percent by weight of silicon, manganese and nickel satisfy the relationship $0.7 \leqq Y/(V+U) \leqq 6$; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and μ phase. The seventh copper alloy will be hereinafter called the "seventh invention alloy."

Manganese and nickel combine with silicon to form intermetallic compounds represented by $Mn_xSi_y$ or $Ni_xSi_y$, which are evenly precipitated in the matrix, thereby raising the wear resistance and strength. Therefore, the addition of manganese and nickel or either of the two would improve the high strength feature and wear resistance. Such effects will be exhibited if manganese and nickel are added in an amount not smaller than 0.7 percent by weight, respectively. But the saturation state is reached at 3.5 percent by weight, and even if the addition is increased beyond that, no proportional results will be obtained. The addition of silicon is set at 2.5 to 4.5 percent by weight to match the addition of manganese or nickel, taking into consideration the consumption to form intermetallic compounds with those elements.

It is also noted that aluminum, and phosphorus help to reinforce the alpha phase in the matrix, thereby improving the machinability. Phosphorus disperses the alpha and gamma phases, by which the strength, wear resistance, and also machinability are improved Aluminum also contributes to improving the wear resistance and exhibits its effect of reinforcing the matrix when added in an amount of 0.2 or more percent by weight. But if the addition exceeds 2.5 percent by weight, there will be a decrease in ductility.

Therefore, the addition of aluminum is set at 0.2 to 2.5 in consideration of improvement of machinability. Also, the addition of phosphorus disperses the gamma phase and at the same time pulverizes the crystal grains in the alpha phase in the matrix, thereby improving the hot workability and also the strength and wear resistance. Furthermore, it is very effective in improving the flow of molten metal in casting. Such results will be produced when phosphorus is added in an amount of 0.02 to 0.25 percent by weight. The content of copper is set at 62 to 78 percent by weight in the light of the addition of silicon and the property of manganese and nickel of combining with silicon.

A free-cutting copper alloy also with an excellent easy-to-cut feature and with an excellent high-temperature oxidation resistance which comprises 69 to 79 percent, by weight, of copper, 2.0 to 4.0 percent, by weight, of silicon, 0.02 to 0.4 percent, by weight, of lead, 0.1 to 1.5 percent, by weight, of aluminum, and 0.02 to 0.25 percent, by weight, of phosphorus, and the remaining percent, by weight, of zinc, wherein the percent by weight of copper, silicon, aluminum, and phosphorous in the copper alloy satisfy the relationship $60 \leqq X-3Y+aZ+bW \leqq 70$, wherein X is the percent, by weight, of copper, Y is the percent, by weight, of silicon, Z is the percent, by weight, of aluminum, W is the percent, by weight, of phosphorous, a is −2, and b is −3; and the copper alloy has a metal construction comprising multiple phases integrated to form a composite phase, wherein the composite phase is an α phase matrix having a total phase area comprising not more than 5% of β phase, and 5–70% of the total phase area is provided by at least one phase selected from the group consisting of a γ phase, a κ phase, and a μ phase. The eighth copper alloy will be hereinafter called the "eighth invention alloy."

Aluminum is an element which improves strength, machinability, wear resistance, and also high-temperature oxidation resistance. Silicon, too, has a property of enhancing machinability, strength, wear resistance, resistance to stress corrosion cracking, and also high-temperature oxidation resistance. Aluminum works to raise the high-temperature oxidation resistance when it is used together with silicon in amounts not smaller than 0.1 percent by weight. But even if the addition of aluminum increases beyond 1.5 percent by weight, no proportional results can be expected. For this reason, the addition of aluminum is set at 0.1 to 1.5 percent by weight.

Phosphorus is added to enhance the flow of molten metal in casting. Phosphorus also works to improve the aforesaid machinability, de-zinc-ification corrosion resistance, and also high-temperature oxidation resistance, in addition to the flow of molten metal. Those effects are exhibited when phosphorus is added in amounts not smaller than 0.02 percent by weight. But even if phosphorus is used in amounts greater than 0.25 percent by weight, it will not result in a proportional increase in effect, rather weakening the alloy. Based upon this consideration, phosphorus is added to within a range of 0.02 to 0.25 percent by weight.

While silicon is added to improve machinability as mentioned above, it is also capable of improving the flow of molten metal like phosphorus. The effect of silicon in improving the flow of molten metal is exhibited when it is added in an amount not smaller than 2.0 percent by weight. The range of the addition for flow improvement overlaps that for improvement of the machinability. These taken into consideration, the addition of silicon is set to 2.0 to 4.0 percent by weight.

A free-cutting copper alloy also with excellent easy-to-cut feature coupled with a good high-temperature oxidation resistance which is composed of 69 to 79 percent, by weight, of copper; 2.0 to 4.0 percent, by weight, of silicon; 0.02 to 0.4 percent, by weight, of lead; 0.1 to 1.5 percent, by weight, of aluminum; 0.02 to 0.25 percent, by weight, of phosphorus; one element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc, wherein the percent by weight of copper, silicon, aluminum, and phosphorous in the copper alloy satisfy the relationship $60 \leqq X-3Y+aZ+bW \leqq 70$, wherein X is the percent, by weight, of copper, Y is the percent, by weight, of silicon, Z is the percent, by weight, of aluminum, W is the percent, by weight, of phosphorous, a is −2, and b is −3; and the copper alloy has a metal construction comprising multiple phases integrated to form a composite phase, wherein the composite phase is an α phase matrix having a total phase area comprising not more than 5% of β phase, and 5–70% of the total phase area is provided by at least one phase selected from the group consisting of a γ phase, a κ phase, and a μ phase. The ninth copper alloy will be hereinafter called the "ninth invention alloy."

The ninth invention alloy contains one element selected from among 0.02 to 0.4 percent, by weight, of bismuth, 0.02 to 0.4 percent, by weight, of tellurium and 0.02 to 0.4 percent, by weight, of selenium in addition to the components of the eighth invention alloy. While a high-temperature oxidation resistance as good as in the eighth invention alloy is secured, the machinability is further improved by adding one element selected from among bismuth and other elements which are as effective as lead in raising the machinability, A free-cutting copper alloy also with excellent easy-to-cut feature and a good high-temperature oxidation resistance which is composed of 69 to 79 percent, by weight, of copper; 2.0 to 4.0 percent, by weight, of silicon; 0.02 to 0.4 percent, by weight, of lead; 0.1 to 1.5 percent, by weight, of aluminum; 0.02 to 0.25 percent, by weight, of phosphorus; at least one selected from among 0.02 to 0.4 percent, by weight, of chromium and 0.02 to 0.4 percent, by weight, of titanium; and the remaining percent, by weight, of zinc, wherein the percent by weight of copper, silicon, aluminum, phosphorous and chromium in the copper alloy satisfy the relationship $60 \leqq X-3Y+aZ+bW+cV \leqq 70$, wherein X is the percent, by weight, of copper, Y is the percent, by weight, of silicon, Z is the percent, by weight, of aluminum, W is the percent, by weight, of phosphorous, V is the percent, by weight, of chromium, a is −2, b is −3, and c is 2; and the copper alloy has a metal construction comprising multiple phases integrated to form a composite phase, wherein the composite phase is an α phase matrix having a total phase area comprising not more than 5% of β phase, and 5–70% of the total phase area is provided by at least one phase selected from the group consisting of a γ phase, a κ phase, and a μ phase. The tenth copper alloy will be hereinafter called the "tenth invention alloy."

Chromium and titanium are intended for improving the high-temperature oxidation resistance of the alloy. Good results can be expected especially when they are added together with aluminum to produce a synergistic effect. Those effects are exhibited when the addition is no less than 0.02 percent by weight, whether they are added alone or in combination. The saturation point is 0.4 percent by weight. For consideration of such observations, the tenth invention alloy has at least one element selected from among 0.02 to 0.4 percent by weight of chromium and 0.02 to 0.4 percent by weight of titanium in addition to the components of the eighth invention alloy and thus further improved over the eighth invention alloy with regard to high-temperature oxidation resistance.

A free-cutting copper alloy also with excellent easy-to-cut feature and a good high-temperature oxidation resistance which is composed of 69 to 79 percent, by weight, of copper; 2.0 to 4.0 percent, by weight, of silicon; 0.02 to 0.4 percent, by weight, of lead; 0.1 to 1.5 percent, by weight, of aluminum; 0.02 to 0.25 percent, by weight, of phosphorus; at least one element selected from among 0.02 to 0.4 percent, by weight, of chromium and 0.02 to 0.4 percent, by weight, of titanium; one element selected from among 0.02 to 0.4 percent, by weight, of bismuth, 0.02 to 0.4 percent, by weight, of tellurium and 0.02 to 0.4 percent, by weight, of selenium; and the remaining percent, by weight, of zinc, wherein the percent by weight of copper, silicon, aluminum, phosphorous and chromium in the copper alloy satisfy the relationship $60 \leqq X-3Y+aZ+bW+cV \leqq 70$, wherein X is the percent, by weight, of copper, Y is the percent, by weight, of silicon, Z is the percent, by weight, of aluminum, W is the percent, by weight, of phosphorous, V is the percent, by weight, of chromium, a is −2, b is −3, and c is 2; and the copper alloy has a metal construction comprising multiple phases integrated to form a composite phase, wherein the composite phase is an α phase matrix having a total phase area comprising not more than 5% of β phase, and 5–70% of the total phase area is provided by at least one phase selected from the group consisting of a γ phase, a κ phase, and a μ phase. The eleventh copper alloy will be hereinafter called the "eleventh invention alloy."

The eleventh invention alloy contains any one element selected from among 0.02 to 0.4 percent, by weight, of bismuth, 0.02 to 0.4 percent, by weight, of tellurium, and 0.02 to 0.4 percent, by weight, of selenium, in addition to the components of the tenth invention alloy. While as high a high-temperature oxidation resistance as in the tenth invention alloy is secured, the eleventh invention alloy is further improved in machinability by adding one element selected from among bismuth and these other elements, which are as effective as lead in improving machinability.

A free-cutting copper alloy with further improved easy-to-cut properties, obtained by subjecting any one of the preceding respective invention alloys to a heat treatment for 30 minutes to 5 hours at 400 to 600° C. The twelfth copper alloy will be hereinafter called the "twelfth invention alloy."

The first to eleventh invention alloys contain machinability improving elements such as silicon and have an excellent machinability because of the addition of such elements. The effect of those machinability improving elements could be further enhanced by heat treatment. For example, the first to eleventh invention alloys which are high in copper content with gamma phase in small quantities and kappa phase in large quantities undergo a change in phase from the kappa phase to the gamma phase in a heat treatment. As a result, the gamma phase is finely dispersed and precipitated, and the machinability is improved. In the manufacturing process of castings, expanded metals and hot forgings in practice, the materials are often force-air-cooled or water cooled depending on the forging conditions, productivity after hot working (hot extrusion, hot forging, etc.), working environment, and other factors. In such cases, with the first to eleventh invention alloys, the alloys with a low content of copper in particular are rather low in the content of the gamma phase and contain beta phase. In a heat treatment, the beta phase changes into gamma phase, and the gamma phase is finely dispersed and precipitated, whereby the machinability is improved.

But a heat treatment temperature at less than 400° C. is not economical and practical in any case, because the aforesaid phase change will proceed slowly and much time will be needed. At temperatures over 600° C., on the other hand, the kappa phase will grow or the beta phase will appear, bringing about no improvement in machinability. From the practical viewpoint, therefore, it is desired to perform the heat treatment for 30 minutes to 5 hours at 400 to 600° C.

DETAILED DESCRIPTION OF PREFERRED EMBODIMENTS

EXAMPLE 1

Figure 1:
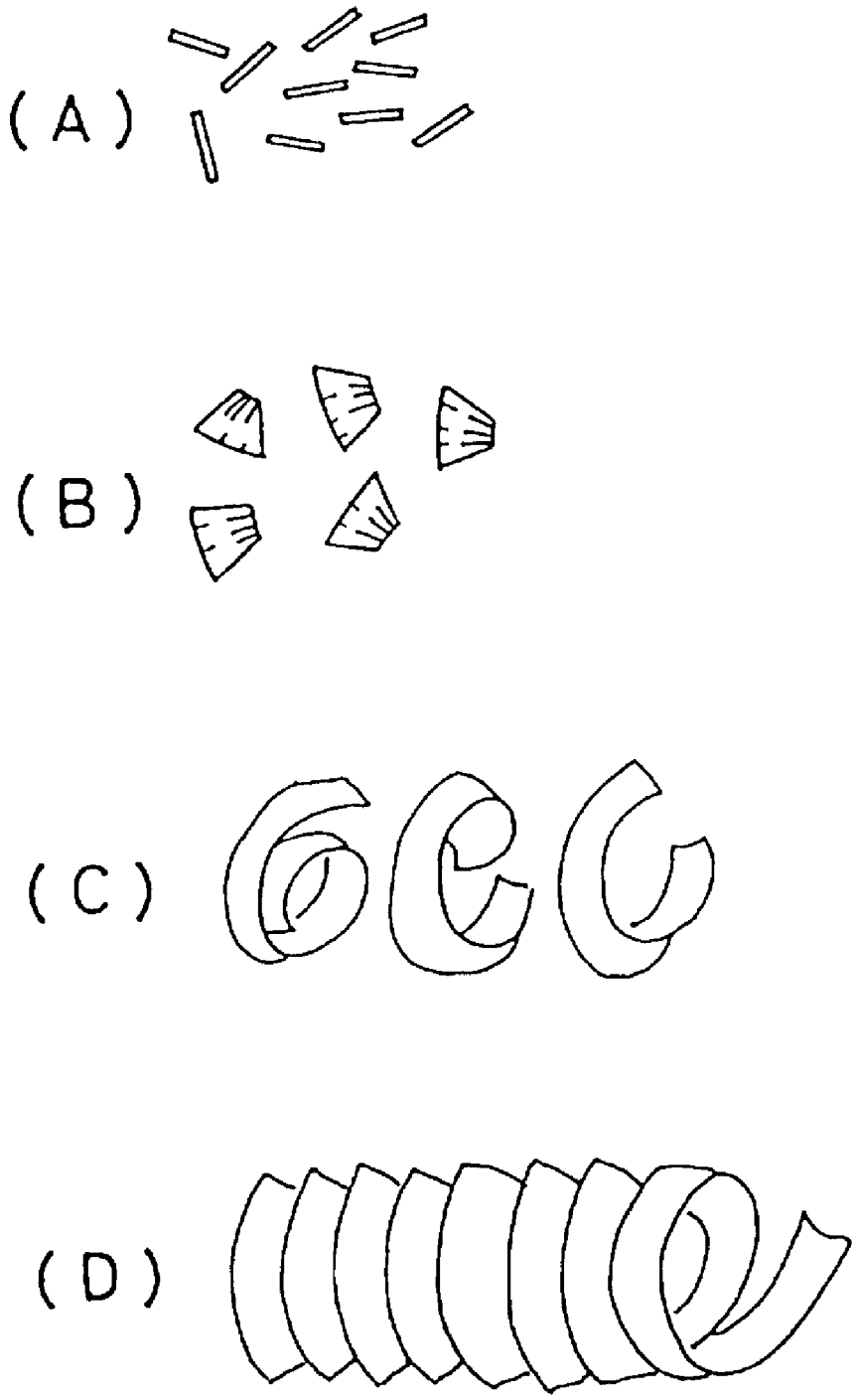
FIG. 1 shows perspective views of cuttings formed in cutting a round bar of copper alloy by lathe.

As the first series of examples of the present invention, cylindrical ingots with compositions given in Tables 1 to 15, each 100 mm in outside diameter and 150 mm in length, were hot extruded into a round bar 15 mm in outside diameter at 750° C. to produce the following test pieces: first invention alloys Nos. 1001 to 1007, second invention alloys Nos. 2001 to 2006, third invention alloys Nos. 3003 to 3009, fourth invention alloys Nos. 4002 to 4020, fifth invention alloys Nos. 5003 to 5016, sixth invention alloys Nos. 6009 to 6015, seventh invention alloys Nos. 7018 to 7029, eight invention alloys Nos. 8001 to 8008, ninth invention alloys Nos. 9001 to 9006, tenth invention alloys Nos. 10001 to 10008, and eleventh invention alloys Nos. 11001 to 11011. Also, cylindrical ingots with the compositions given in Table 16, each 100 mm in outside diameter and 150 mm in length, were hot extruded into a round bar 15 mm in outside diameter at 750° C. to produce the following test pieces: twelfth invention alloys Nos. 12001 to 12004. That is, No. 12001 is an alloy test piece obtained by heat-treating an extruded test piece with the same composition as first invention alloy No. 1006 for 30 minutes at 580° C. No. 12002 is an alloy test piece obtained by heat-treating an extruded test piece with the same composition as No. 1006 for two hours at 450° C. No. 12003 is an alloy test piece obtained by heat-treating an extruded test piece with the same composition as first invention alloy No. 1007 under the same conditions as for No. 12001—for 30 minutes at 580° C. No. 12004 is an alloy test piece obtained by heat-treating an extruded test piece with the same composition as No. 1007 under the same conditions as for No. 12002—for two hours at 450° C.

As comparative examples from the prior art, cylindrical ingots with the compositions as shown in Table 17, each 100 mm in outside diameter and 150 mm in length, were hot extruded into a round bar 15 mm in outside diameter at 750° C. to obtain the following round extruded test pieces: Nos. 13001 to 13006 (hereinafter referred to as the "conventional alloys"). No. 13001 corresponds to the alloy "JIS C 3604," No. 13002 to the alloy "CDA C 36000," No. 13003 to the alloy "JIS C 3771," and No. 13004 to the alloy "CDA C 69800." No. 13005 corresponds to the alloy "JIS C 6191." This aluminum bronze is the most excellent of the expanded copper alloys under the JIS designations with regard to strength and wear resistance. No. 13006 corresponds to the navel brass alloy "JIS C 4622" and is the most excellent of the expanded copper alloys under the JIS designations with regard to corrosion resistance.

To study the machinability of the first to twelfth invention alloys in comparison with the conventional alloys, cutting tests were carried out. In the test, evaluations were made on the basis of cutting force, condition of chippings, and cut surface condition. The tests were conducted in this manner: The extruded test pieces thus obtained were cut on the circumferential surface by a lathe provided with a point noise straight tool at a rake angle of −8 degrees and at a cutting rate of 50 meters/minute, a cutting depth of 1.5 mm, and a feed of 0.11 mm/rev. Signals from a three-component dynamometer mounted on the tool were converted into electric voltage signals and recorded on a recorder. The signals were then converted into the cutting resistance. It is noted that while, to be perfectly exact, the amount of the cutting resistance should be judged by three component forces—cutting force, feed force, and thrust force, the judgement was made on the basis of the cutting force (N) of the three component forces in the present example. The results are shown in Table 18 to Table 33.

Furthermore, the chips from the cutting work were examined and classified into four forms (A) to (D) as shown in FIG. 1. The results are enumerated in Table 18 to Table 33. In this regard, the chippings in the form of a spiral with three or more windings as (D) in FIG. 1 are difficult to process, that is, recover or recycle, and could cause trouble in cutting work as, for example, getting tangled with the tool and damaging the cut metal surface. Chippings in the form of a spiral arc from one with a half winding to one with two windings as shown in (C) in FIG. 1 do not cause such serous trouble as chippings in the form of a spiral with three or more windings, yet are not easy to remove and could get tangled with the tool or damage the cut metal surface. In contrast, chippings in the form of a fine needle as (A) in FIG. 1 or in the form of arc shaped pieces as (B) in FIG. 1 will not present such problems as mentioned above, are not as bulky as the chippings in (C) and (D), and are easy to process. But fine chipping as (A) still could creep in on the slide table of a machine tool such as a lathe and cause mechanical trouble, or could be dangerous because they could stick into the worker's finger, eye, or other body parts. Those factors taken into account, when judging machinability, the alloy with the chippings in (B) is the best, and the second best is that with the chippings in (A). Those with the chippings in (C) and (D) are not good. In Table 18 to Table 33, the alloys with the chippings shown in (B), (A), (C), and (D) are indicated by the symbols "◎", "○", "Δ", and "x" respectively.

In addition, the surface condition of the cut metal surface was checked after cutting work. The results are depicted in Table 18 to Table 33. In this regard, the commonly used basis for indicating the surface roughness is the maximum roughness (Rmax). While requirements are different depending on the field of application of articles made from the brass, brass alloys with Rmax<10 microns are generally considered excellent in machinability. The alloys with 10 microns≦Rmax<15 microns are judged as industrially acceptable. Brass alloys with Rmax≧15 microns are taken as poor in machinability. In Table 18 through Table 33, the alloys with Rmax<10 microns are marked "○", those with 10 microns≦Rmax<15 microns are indicated by "Δ", and those with Rmax≧15 microns are indicated by "x".

As is evident from the results of the cutting tests shown in Table 18 to Table 33, the following invention alloys are all equal to the conventional lead-containing alloys Nos. 13001 to 13003 in machinability: first invention alloys Nos. 1001 to 1006, second invention alloys Nos. 2001 to 2006, third invention alloys Nos. 3003 to 3009, fourth invention alloys Nos. 4002 to 4020, fifth invention alloys Nos. 5003 to 5016, sixth invention alloys Nos. 6009 to 6045, seventh invention alloys Nos. 7018 to 7029, eighth invention alloys Nos. 8001 to 8008, ninth invention alloys Nos. 9001 to 9006, tenth invention alloys Nos. 10001 to 10008, eleventh invention alloys Nos. 11001 to 11011, and twelfth invention alloys Nos. 12001 to 12004. Especially with regard to the form of chippings, those invention alloys compare favorably not only with conventional alloys Nos. 13004 to 13006, which have a lead content of not higher than 0.1 percent by weight, but also Nos. 13001 to 13003, which contain large quantities of lead. Also to be remarked is that twelfth invention alloys Nos. 12001 to 12004, which are obtained by heat-treating first invention alloys Nos. 1006 and 1007, are improved over the first invention alloys in machinability. It is understood that a proper heat treatment could likewise further enhance machinability of the first to eleventh invention alloys, depending upon the compositions of the alloys and other conditions.

In another series of tests, the first to twelfth invention alloys were examined in comparison with conventional alloys in hot workability and mechanical properties. For the purpose, hot compression and tensile tests were conducted in the following manner.

First, two test pieces, the first and second test pieces, in the same shape, 15 mm in outside diameter and 25 mm in length, were cut out of each extruded test piece obtained as described above. In hot compression tests, the first test piece was held for 30 minutes at 700° C., and then compressed at the compression rate of 70 percent in the axial direction to reduce the length from 25 mm to 7.5 mm. The surface condition after the compression (700° C. deformability) was visually evaluated. The results are given in Table 18 to Table 33. The evaluation of deformability was made by visually checking for cracks on the side of the test piece. In Table 18 to Table 33, the test pieces with no cracks found are marked "○", those with small cracks are indicated by "Δ", and those with large cracks are represented by the symbol "x".

The tensile strength, $N/mm^2$, and elongation, %, of the second test pieces was determined by the commonly practiced test method as will be recognized by one skilled in the art.

As the test results of the hot compression and tensile tests in Table 18 to Table 33 indicate, it was confirmed that the first to twelfth invention alloys are equal to or superior to the conventional alloys Nos. 13001 to 13004 and No. 13006 in hot workability and mechanical properties and are suitable for industrial use. The seventh invention alloys in particular have the same level of mechanical properties as the conventional alloy No. 13005, i.e. the aluminum bronze which is the most excellent in strength of the expanded copper alloys under the JIS designations, and thus clearly have a prominent high strength feature.

Furthermore, the first to six and eighth to twelfth invention alloys were put to de-zinc-ification corrosion and stress corrosion cracking tests in accordance with the test methods specified under "ISO 6509" and "JIS H 3250", respectively, to examine the corrosion resistance and resistance to stress corrosion cracking in comparison with conventional alloys.

In the de-zinc-ing corrosion test by the "ISO 6509" method, the test piece taken from each extruded test piece was imbedded laid in a phenolic resin material in such a way that the exposed test piece surface is perpendicular to the extrusion direction of the extruded test piece. The surface of the test piece was polished with emery paper No. 1200, and then ultrasonic-washed in pure water and dried. The test piece thus prepared was dipped in a 12.7 g/l aqueous solution of cupric chloride dihydrate ($CuCl_2.2H_2O$) 1.0% and left standing for 24 hours at 75° C. The test piece was taken out of the aqueous solution and the maximum depth of de-zinc-ing corrosion was determined. The measurements of the maximum de-zinc-ification corrosion depth are given in Table 18 to Table 25 and Table 28 to Table 33.

As is clear from the results of de-zinc-ification corrosion tests shown in Table 18 to Table 25 and Table 28 to Table 33, the first to fourth invention alloys and the eighth to twelfth invention alloys are excellent in corrosion resistance in comparison with the conventional alloys Nos. 13001 to 13003 which contain large amounts of lead. And it was confirmed that especially the fifth and sixth invention alloys which whose improvement in both machinability and corrosion resistance has been intended are very high in corrosion resistance in comparison with the conventional alloy No. 13006, a naval brass which is the most resistant to corrosion of all the expanded alloys under the JIS designations.

In the stress corrosion cracking tests in accordance with the test method described in "JIS H 3250," a 150-mm-long test piece was cut out from each extruded material. The test piece was bent with the center placed on an arc-shaped tester with a radius of 40 mm in such a way that one end forms an angle of 45 degrees with respect to the other end. The test piece thus subjected to a tensile residual stress was degreased and dried, and then placed in an ammonia environment in the desiccator with a 12.5% aqueous ammonia (ammonia diluted in the equivalent of pure water). To be exact, the test piece was held some 80 mm above the surface of aqueous ammonia in the desiccator. After the test piece was left standing in the ammonia environment for 2 hours, 8 hours, and 24 hours, the test piece was taken out from the desiccator, washed in sulfuric acid solution 10% and examined for cracks under 10× magnifications. The results are given in Table 18 to Table 25 and Table 28 to Table 33. In those tables, the alloys which developed clear cracks when held in the ammonia environment for two hours are marked "xx." The test pieces which had no cracks at 2 hours but were found clearly cracked in 8 hours are indicated by "x." The test pieces which had no cracks at 8 hours, but were found to clearly have cracks in 24 hours are identified by the symbol "Δ". The test pieces which were found to have no cracks at all in 24 hours are indicated by the symbol "○."

As is indicated by the results of the stress corrosion cracking test given in Table 18 to Table 25 and Table 28 to Table 33, it was confirmed that not only the fifth and sixth invention alloys whose improvement in both machinability and corrosion resistance has been intended but also the first to fourth invention alloys and the eighth to twelfth alloys in which nothing particular was done to improve corrosion resistance were both equal to the conventional alloy No. 13005, an aluminum bronze containing no zinc, in stress corrosion cracking resistance. Those invention alloys were superior in stress corrosion cracking resistance to the conventional naval brass alloy No. 13006, the best in corrosion resistance of all the expanded copper alloys under the JIS designations.

In addition, oxidation tests were carried out to study the high-temperature oxidation resistance of the eighth to eleventh invention alloys in comparison with conventional alloys.

Test pieces in the shape of a round bar with the surface cut to a outside diameter of 14 mm and the length cur to 30 mm were prepared from each of the following extruded materials: No. 8001 to No. 8008, No. 9001 to No. 9006, No. 10001 to No. 10008, No. 11001 to No. 11011, and No. 13001 to No. 13006. Each test piece was then weighed to measure the weight before oxidation. After that, the test piece was placed in a porcelain crucible and held in an electric furnace maintained at 500° C. At the passage of 100 hours, the test piece was taken out of the electric furnace and was weighed to measure the weight after oxidation. From the measurements before and after oxidation was calculated the increase in weight by oxidation. It is understood that the increase by oxidation is the amount, in milligrams (mg), of increase in weight by oxidation per 10 $cm^2$ of the surface area of the test piece, and is calculated by the equation: increase in weight by oxidation, mg/10 $cm^2$=(weight, mg, after oxidation−weight, mg, before oxidation)×(10 $cm^2$/surface area, $cm^2$, of test piece). The weight of each test piece increased after oxidation. The increase was brought about by high-temperature oxidation. Subjected to a high temperature, oxygen combines with copper, zinc, and silicon to form $Cu_2O$, ZnO, $SiO_2$, respectively. That is, oxygen adds to the weight. It can be said, therefore, that the alloys with a smaller weight increase due to oxidation are better in high-temperature oxidation resistance. The results obtained are shown in Table 28 to Table 31 and Table 33.

As is evident from the test results shown in Table 28 to Table 31 and Table 33, the eighth to eleventh invention alloys are equal, in regard to weight increase by oxidation, to the conventional alloy No. 13005, an aluminum bronze ranking high in resistance to high-temperature oxidation among the expanded copper alloys under the JIS designations, and are far smaller than any other conventional copper alloy. Thus, it was confirmed that the eighth to eleventh invention alloys are very excellent in machinability as well as resistance to high-temperature oxidation.

EXAMPLE 2

As the second series of examples of the present invention, circular cylindrical ingots with compositions given in Tables 10 and 11, each 100 mm in outside diameter and 200 mm in length, were hot extruded into a round bar 35 mm in outside diameter at 700° C. to produce seventh invention alloys Nos. 70018 to 7029a. In parallel, circular cylindrical ingots with compositions given in Table 17, each 100 mm in outside diameter and 200 mm in length, were hot extruded into a round bar 35 mm in outside diameter at 700° C. to produce the following alloy test pieces: Nos. 13001a to 13006a as second comparative prior art examples (hereinafter referred to as the "conventional alloys). It is noted that the alloys Nos. 7018a to 7029a and Nos. 13001 a to 13006a are identical in composition with the aforesaid copper alloys Nos. 7018 to 7029 and Nos. 13001 to No. 13006, respectively.

Seventh invention alloys Nos. 7018a to 7029a were subjected to wear resistance tests in comparison with conventional alloys Nos. 13001a to 13006a.

The tests were carried out in this manner. Each extruded test piece thus obtained was cut on the circumferential surface, holed, and cut down into a ring-shaped test piece 32 mm in outside diameter and 10 mm in thickness (that is, the length in the axial direction). The test piece was then fitted and clamped on a rotatable shaft, and a roll 48 mm in diameter placed in parallel with the axis of the shaft was thrust against the test piece under a load of 50 kg. The roll was made of stainless steel having the JIS designation SUS 304. Then, the SUS 304 roll and the test piece put against the roll were rotated at the same number of revolutions/minute—209 r.p.m., with multipurpose gear oil being dropping on the circumferential surface of the test piece. When the number of revolutions reached 100,000, the SUS 304 roll and the test piece were stopped, and the weight difference between before rotation and after the end of rotation, that is, the loss of weight by wear, mg, was determined. It can be said that the alloys which are smaller in the loss of weight by wear are higher in wear resistance. The results are given in Tables 34 to 36.

As is clear from the wear resistance test results shown in Tables 34 to 36, the tests showed that those seventh invention alloys Nos. 7018a to 7029a were excellent in wear resistance as compared with not only the conventional alloys Nos. 13001a to 13004a and 13006a but also No. 13005a, which is an aluminum bronze most excellent in wear resistance among expanded copper designated in JIS. From comprehensive considerations of the test results including the tensile test results, it may safely be said the seventh invention alloys are excellent in machinability and also possess a high strength feature and wear resistance equal to or superior to the aluminum bronze which is the highest in wear resistance of all the expanded copper alloys under the JIS designations.

EXAMPLE 3

In yet another series of tests, first and third invention alloys were examined for impact resistance. Then tin was added to these first and third invention alloys to show the affect of tin on the copper alloys of the present invention.

In general, mechanical property standards for metals, such as tensile strength, elongation, proof stress, hardness and others, are specified under JIS and ASTM standard. However, a measurement of metal impact resistance, such as the Charpy impact value, is not so specified under these standards. However, there are metal products that need to be impact resistant. For example, some products undergo a cutting process followed by a caulking process during manufacture, which requires that the metal material be impact resistant. Relevant product examples include tube connectors called "nipples, metal hinges for furniture, automobile sensors, and the like. To determine the impact resistance of the copper alloys of the present invention and to show that tin should be excluded from the alloys of the present invention, the Charpy impact test is used.

Table 9 includes impact resistance data collected on the copper alloys of the present invention and shows how the addition of tin to the alloys of the present invention adversely affects the impact resistance of the alloys of the present invention. Specifically, test pieces of identical size and shape were evaluated for impact resistance by conducting the Charpy impact test using the test machine specified under Japanese Industrial Standard (JIS) B 7722 in accordance with the standard testing method specified under JIS Z 2242. This test corresponds to International Standard ISO R 83, and is also specified under ASTM E23 in the United States. Hence, the Charpy impact test is widely known as will be appreciated by one skilled in the art.

The Charpy impact test demonstrates the degree of resistance a material has against a dynamic impact. The test generates an "impact value" in Joules/cm (J/cm) from which the toughness and the brittleness of a metal is assessed. In Table 1, copper alloys 1 and 4 are first invention alloys, whereas copper alloys 3 and 6 are third invention alloys. It is noted that the third invention alloys have the highest impact values and are the most suitable material for making nipples. However, when even a small amount of tin is added to the copper alloys of the present invention, such as about one percent, by weight, the impact value diminishes greatly. Therefore, it is a feature of the copper alloys of the present invention that each is substantially tin free. In other words, the copper alloys of the present invention, having a high degree of impact resistance, contain essentially no tin.

Alloy Composition Constraint Formula

Another feature of the copper alloys of the present invention is that each copper alloy composition is constrained by the general formula relationship $$60 \leqq X-3Y+a_0Z_0 \leqq 70 \quad (1)$$

where X is the percent, by weight, of copper; Y is the percent, by weight, of silicon; and $a_0Z_0$ represents the contribution to the relationship of elements other than copper, silicon and zinc. In other words, the relationship described by the alloy composition constraint formula (1) is required to make copper alloy compositions with the advantages described above. If formula (1) is not satisfied, then by experiment it has been found that the resulting copper alloy does not provide the degree of machinability and other properties shown in Tables 18–32.

We describe the contribution to the relationship of constraint formula (1) by elements other than copper, silicon and zinc in formula (2) as follows:

$$a_0Z_0=a_1Z_1+a_2Z_2+a_3Z_3+ \quad (2)$$

where $a_1$, $a_2$, $a_3$, etc., are experimentally determined coefficients, and $Z_1$, $Z_2$, $Z_3$, etc., are percents, by weight, of elements in the composition other than copper, silicon and zinc.

Specifically, it has been determined that in order to practice the copper alloys of the present invention, the "a" coefficients are as follows: for lead, bisthmuth, tellurium, selenium, antimony, arsenic and titanium, the a coefficient is zero; for aluminum, the a coefficient is −2; for phosphorus, the a coefficient is −3; for chromium, the a coefficient is +2; and for manganese and nickel, the a coefficient is +2.5. It will be appreciated by one skilled in the art, that formula (1) does not directly constrain the amounts of lead, bismuth, tellurium, selenium, antimony, arsenic and titanium in the copper alloys of the present invention because the a coefficient is zero for these elements; however, these elements are indirectly constrained by the fact that the percent, by weight, of copper, silicon, and those elements in the copper alloy and having non-zero a coefficients must satisfy constraint formula (1).

To be even more specific, for the first and second invention alloys, constraint formula (1) can be written as:

$$60 \leqq X-3Y \leqq 70, \quad (3)$$

where X is the percent, by weight, of copper and Y is the percent, by weight, of silicon in the alloy.

For the third, fourth, eighth and nineth invention alloys, constraint formula (1) can be written as:

$$60 \leqq X-3Y+aZ+bW \leqq 70, \quad (4)$$

where X is the percent, by weight, of copper; Y is the percent, by weight, of silicon; Z is the percent, by weight of aluminum; W is the percent, by weight, of phosphorus in the alloy; a is −2; and b is −3.

For the fifth, sixth and twelfth invention alloys, constraint formula (1) can be written as:

$$60 \leqq X-3Y+aZ \leqq 70, \quad (5)$$

where X is the percent, by weight, of copper; Y is the percent, by weight, of silicon; Z is the percent, by weight of phosphorus in the alloy; and a is −3.

For the tenth and eleventh invention alloys, constraint formula (1) can be written as:

$$60 \leqq X-3Y+aZ+bW+cV \leqq 70, \quad (6)$$

where X is the percent, by weight, of copper; Y is the percent, by weight, of silicon; Z is the percent, by weight of aluminum; W is the percent, by weight, of phosphorus; V is the percent, by weight, of chromium in the alloy; a is −2; b is −3; and c is +2.

For the seventh invention alloy, constraint formula (1) can be written as:

$$60 \leqq X-3Y+aZ+bW+cV+dU \leqq 70, \quad (7)$$

where X is the percent, by weight, of copper; Y is the percent, by weight, of silicon; Z is the percent, by weight of aluminum; W is the percent, by weight, of phosphorus; V is the percent, by weight, of manganese; U is the percent, by weight, of nickel; a is −2; b is −3; c is +2.5; and d is +2.5. It has also been determined for the seventh invention alloy that a secondary alloy composition constraint is necessary to practice the invention. This secondary alloy composition constraint formula is a ratio involving silicon, manganese and nickel describing the constraining composition as follows:

$$0.7 \leqq Y/(V+U) \leqq 6, \quad (8)$$

where Y, V and U are the percents, by weight, of silicon, manganese, and nickel respectively.

To summarize, all of the first through the twelfth invention alloys of the present invention must satisfy the alloy composition constraint of Formula 1, and all of the illustrative examples in Tables 1–8 and 10–16 comply with this composition constraint. Only the seventh invention alloy is further constrained by the secondary alloy composition constraint of Formula 8. Other copper alloys that contain include the same elements as the copper alloys of the present invention, but which do not have a composition satisfying the requirements of Formula 1, and when appropriate Formula 8 as well, will not have the characteristics of the copper alloys disclosed in Tables 1–8 and 10–16.

Metal Construction

Another important feature of the copper alloys of the present invention is the metal construction, being the matrix of the metal, formed by the integration of multiple phase states of the component metals, which produces a composite phase for the copper alloy. Specifically, as one skilled in the art will appreciate, a given metal alloy may have different characteristics depending upon the environment in which it was produced. For example, applying heat to temper steel is well known. The fact that a given metal alloy may behave differently depending upon the conditions in which it was forged is due to the integration and conversion of components of the metal to different phase states. As is illustrated in Tables 1–8 and 10–16, the copper alloys of the present invention all include an α phase of about 30 percent or more of the total phase area to practice the invention. This is because the α phase is the only phase that gives metal alloys a degree of cold workability. In other words, if the copper alloy has less than about 30% α phase comprising the total phase area of the metal, then the copper alloy is not cold workable and can not be further processed by cutting in any practical manner. Therefore, all of the copper alloys of the present invention have a metal construction that is a composite phase that is an α phase matrix to which other phases are provided.

As mentioned above, the presence of silicon in the copper alloys of the present invention is to improve the machinability of the copper alloy, and this occurs partly because silicon induces a γ phase. Silicon concentrations in any one of the γ, κ, and μ phases of a copper alloy are 1.5 to 3.5 times as high as that in the α phase. Silicon concentrations in the various phases, from high to low, are as follows: $\mu \geqq \gamma \geqq \kappa \geqq \beta \geqq \alpha$. The γ, κ, and μ phases also share the characteristic that they are harder and more brittle than the α phase, and impart an appropriate hardness to the alloy so that the alloy is machinable and so that the cuttings formed by machining are less likely to damage the cutting tools as describe regarding FIG. 1. Therefore, to practice the invention, each copper alloy must have at least one of the γ phase, the κ phase, and the μ phase, or any combination of these phases, in the α phase in order to provide a suitable degree of hardness to the copper alloy.

Another goal of the copper alloys of the present invention is to limit the amount of β phase in the a matrix of the metal construction. It is desired to limit the β phase to 5% or less of the total phase area because the β phase does not contribute to either the machinability or the cold workability of the copper alloy. Preferably, the β phase is zero in the metal construction of the present invention, but it is acceptable to have the β phase contribute up to 5% of the total phase area.

Therefore, the copper alloys of the present invention, as illustrated in Tables 1–8 and 10–16, are constrained to a metal construction as follows: (1) an α phase matrix of about 30% or more; (2) a β phase of 5% or less; and consequently (3) any combination of the γ phase, the κ phase, and the μ phase totaling between 5–70% of the total phase area. In other words, the forging conditions described above and in the tables in combination with the elemental composition of the copper alloys of the present invention are constrained so that any one of: (a) α+γ+κ+μphases ($5\% \leqq \gamma+\kappa+\mu \leqq 70\%$), (b) α+γ+κ phases ($5\% \leqq \gamma+\kappa+\mu \leqq 70\%$), (c) α+γ+μ phases ($5\% \leqq \gamma+\mu \leqq \mu \leqq 70\%$), (d) α+κ+μ phases ($5\% \leqq \kappa+\mu \leqq 70\%$), (e) α+γ phases ($5\% \leqq \gamma \leqq 70\%$), (f) α+κ phases ($5\% \leqq \kappa \leqq 70\%$), and (g) α+μ phases ($5\% \leqq \mu \leqq 70\%$), are acceptable composite phases forming the metal construction subject to the caveat that the metal construction includes no more than 5% of the β phase.

Lastly, it is pointed out that although metal constructions are possible where the γ, κ, and μ phases may make up more than 70% of the total phase area, the result is a copper alloy that has no problem with machinability, but has an α phase matrix of less than 30% which results in such a poor degree of cold workability as to render the alloy of no practical value. On the other hand, if the copper has less than 5% of the total phase area comprised of the γ, κ, and μ phases then the machinability of the copper alloy is rendered unsatisfactory. The β phase is minimized to less than 5% of the total phase area because the β phase does not contribute to either the machinability or cold workability of the copper alloy. In addition, because the α phase is the soft phase for the metal construction, and therefore has ductility, the machinability of the copper alloy is greatly improved by adding even an extremely small amount of lead. The result is that the metal construction of the present invention utilizes the α phase as the matrix in which the γ, κ, and μ phases disperse.

While the present invention has been described with reference to certain preferred embodiments, one of ordinary skill in the art will recognize that additions, deletions, substitutions, modifications and improvements can be made while remaining within the spirit and scope of the present invention as defined by the appended claims.

TABLE 1

| | alloy composition (wt %) | | | | metal construction | |
|---|---|---|---|---|---|---|
| No. | Cu | Si | Pb | Zn | phases | $\gamma + \kappa + \mu$ (%) |
| 1001 | 74.8 | 2.9 | 0.03 | remainder | $\alpha + \gamma + \kappa$ | 25 |
| 1002 | 74.1 | 2.7 | 0.21 | remainder | $\alpha + \gamma + \kappa$ | 20 |
| 1003 | 78.1 | 3.6 | 0.10 | remainder | $\alpha + \kappa + \mu$ | 65 |
| 1004 | 70.6 | 2.1 | 0.36 | remainder | $\alpha + \beta + \gamma$ | 10 |

TABLE 1-continued

| | alloy composition (wt %) | | | | metal construction | |
|---|---|---|---|---|---|---|
| No. | Cu | Si | Pb | Zn | phases | $\gamma + \kappa + \mu$ (%) |
| 1005 | 74.9 | 3.1 | 0.11 | remainder | $\alpha + \gamma + \kappa$ | 30 |
| 1006 | 69.3 | 2.3 | 0.05 | remainder | $\alpha + \beta + \gamma$ | 10 |
| 1007 | 78.5 | 2.9 | 0.05 | remainder | $\alpha + \kappa + \mu$ | 25 |

TABLE 2

| | alloy composition (wt %) | | | | | | | metal construction | |
|---|---|---|---|---|---|---|---|---|---|
| No. | Cu | Si | Pb | Bi | Te | Se | Zn | phases | $\gamma + \kappa + \mu$ (%) |
| 2001 | 73.8 | 2.7 | 0.05 | 0.03 | | | remainder | $\alpha + \gamma + \kappa$ | 20 |
| 2002 | 69.9 | 2.0 | 0.33 | 0.27 | | | remainder | $\alpha + \beta + \gamma$ | 10 |
| 2003 | 74.5 | 2.8 | 0.03 | | 0.31 | | remainder | $\alpha + \gamma + \kappa$ | 20 |
| 2004 | 78.0 | 3.6 | 0.12 | | 0.05 | | remainder | $\alpha + \kappa + \mu$ | 65 |
| 2005 | 76.2 | 3.2 | 0.05 | | | 0.33 | remainder | $\alpha + \gamma + \kappa + \mu$ | 40 |
| 2006 | 72.9 | 2.6 | 0.24 | | | 0.06 | remainder | $\alpha + \gamma + \kappa$ | 20 |

TABLE 3

| | alloy composition (wt %) | | | | | | metal construction | |
|---|---|---|---|---|---|---|---|---|
| No. | Cu | Si | Pb | Al | P | Zn | phases | $\gamma + \kappa + \mu$ (%) |
| 3003 | 78.8 | 2.5 | 0.15 | 3.4 | | remainder | $\alpha + \gamma + \kappa$ | 55 |
| 3006 | 74.8 | 2.8 | 0.18 | 1.2 | | remainder | $\alpha + \gamma + \kappa$ | 25 |
| 3004 | 74.9 | 2.7 | 0.09 | | 0.03 | remainder | $\alpha + \gamma + \kappa$ | 35 |
| 3007 | 76.5 | 3.3 | 0.04 | | 0.21 | remainder | $\alpha + \gamma + \kappa + \mu$ | 45 |
| 3009 | 74.9 | 2.0 | 0.35 | 2.7 | 0.13 | remainder | $\alpha + \beta + \gamma + K$ | 40 |

TABLE 4

| | alloy composition (wt %) | | | | | | | | | metal construction | |
|---|---|---|---|---|---|---|---|---|---|---|---|
| No. | Cu | Si | Pb | Al | P | Bi | Te | Se | Zn | phases | $\gamma + \kappa + \mu$ (%) |
| 4002 | 74.5 | 2.6 | 0.11 | 1.5 | | 0.04 | | | remainder | $\alpha + \beta + \gamma + \kappa$ | 30 |
| 4004 | 76.8 | 3.2 | 0.05 | | 0.03 | 0.31 | | | remainder | $\alpha + \gamma + \kappa + \mu$ | 40 |
| 4006 | 75.5 | 1.9 | 0.32 | 3.2 | 0.15 | 0.16 | | | remainder | $\alpha + \beta + \gamma + \kappa$ | 40 |
| 4009 | 79.1 | 2.7 | 0.15 | 3.4 | | | 0.05 | | remainder | $\alpha + \gamma + \kappa + \mu$ | 60 |
| 4010 | 74.5 | 2.8 | 0.10 | | 0.05 | | 0.05 | | remainder | $\alpha + \gamma + \kappa$ | 25 |
| 4012 | 76.8 | 2.8 | 0.05 | 2.0 | 0.03 | | 0.13 | | remainder | $\alpha + \gamma + \kappa$ | 45 |
| 4016 | 76.1 | 2.5 | 0.07 | 2.3 | | | | 0.10 | remainder | $\alpha + \beta + \gamma + \kappa$ | 40 |
| 4018 | 74.0 | 2.5 | 0.23 | | 0.22 | | | 0.03 | remainder | $\alpha + \gamma + \kappa$ | 20 |
| 4020 | 75.3 | 2.7 | 0.22 | 1.4 | 0.03 | | | 0.05 | remainder | $\alpha + \gamma + \kappa$ | 35 |

TABLE 5

| | alloy composition (wt %) | | | | | | | metal construction | |
|---|---|---|---|---|---|---|---|---|---|
| No. | Cu | Si | Pb | P | Sb | As | Zn | phases | $\gamma + \kappa + \mu$ (%) |
| 5003 | 74.8 | 2.8 | 0.03 | 0.08 | | | remainder | $\alpha + \gamma + \kappa$ | 25 |
| 5004 | 78.2 | 3.4 | 0.16 | 0.21 | | | remainder | $\alpha + \kappa + \mu$ | 45 |
| 5005 | 74.9 | 3.1 | 0.09 | | 0.07 | | remainder | $\alpha + \gamma + \kappa$ | 30 |
| 5006 | 72.2 | 2.4 | 0.25 | | | 0.13 | remainder | $\alpha + \gamma$ | 20 |
| 5013 | 74.5 | 2.7 | 0.05 | 0.03 | 0.12 | | remainder | $\alpha + \gamma + \kappa$ | 20 |
| 5014 | 76.1 | 3.1 | 0.14 | 0.18 | 0.03 | | remainder | $\alpha + \gamma + \kappa + \mu$ | 35 |
| 5015 | 73.9 | 2.5 | 0.08 | 0.07 | | 0.05 | remainder | $\alpha + \gamma + \kappa$ | 20 |
| 5016 | 74.5 | 2.8 | 0.07 | | 0.08 | 0.04 | remainder | $\alpha + \gamma + \kappa$ | 25 |

TABLE 6

| | alloy composition (wt %) | | | | | | | | metal construction | |
|---|---|---|---|---|---|---|---|---|---|---|
| No. | Cu | Si | Pb | Bi | P | Sb | As | Zn | phases | $\gamma + \kappa + \mu$ (%) |
| 6009 | 77.0 | 3.1 | 0.14 | 0.06 | 0.21 | | | remainder | $\alpha + \kappa + \mu$ | 40 |
| 6010 | 72.5 | 2.5 | 0.07 | 0.09 | 0.05 | 0.03 | | remainder | $\alpha + \gamma$ | 20 |
| 6011 | 74.7 | 2.9 | 0.10 | 0.32 | 0.14 | | 0.10 | remainder | $\alpha + \gamma + \kappa$ | 30 |
| 6012 | 71.4 | 2.3 | 0.25 | 0.14 | 0.07 | 0.03 | 0.02 | remainder | $\alpha + \gamma$ | 15 |
| 6013 | 74.7 | 3.0 | 0.13 | 0.05 | | 0.12 | | remainder | $\alpha + \gamma + \kappa$ | 30 |
| 6014 | 77.2 | 3.2 | 0.27 | 0.23 | | 0.07 | 0.04 | remainder | $\alpha + \kappa + \mu$ | 45 |
| 6015 | 74.0 | 2.8 | 0.07 | 0.03 | | | 0.03 | remainder | $\alpha + \gamma + \kappa$ | 25 |

TABLE 7

| | alloy composition (wt %) | | | | | | | | | metal construction | |
|---|---|---|---|---|---|---|---|---|---|---|---|
| No. | Cu | Si | Pb | Te | Se | P | Sb | As | Zn | phases | $\gamma + \kappa + \mu$ (%) |
| 6024 | 74.6 | 2.8 | 0.05 | 0.08 | | 0.19 | | | remainder | $\alpha + \gamma + \kappa$ | 25 |
| 6025 | 78.5 | 3.7 | 0.22 | 0.25 | | 0.23 | 0.03 | | remainder | $\alpha + \kappa + \mu$ | 65 |
| 6026 | 74.9 | 2.9 | 0.16 | 0.05 | | 0.05 | | 0.10 | remainder | $\alpha + \gamma + \kappa$ | 30 |
| 6027 | 73.8 | 2.5 | 0.07 | 0.03 | | 0.06 | 0.02 | 0.04 | remainder | $\alpha + \gamma + \kappa$ | 20 |
| 6028 | 74.8 | 2.6 | 0.12 | 0.02 | | | 0.12 | | remainder | $\alpha + \gamma + \kappa$ | 20 |
| 6029 | 74.2 | 2.8 | 0.37 | 0.10 | | | 0.11 | 0.02 | remainder | $\alpha + \gamma + \kappa$ | 25 |
| 6030 | 76.3 | 3.2 | 0.08 | 0.05 | | | | 0.07 | remainder | $\alpha + \gamma + \kappa + \mu$ | 35 |
| 6039 | 71.9 | 2.4 | 0.12 | | 0.17 | 0.04 | | | remainder | $\alpha + \gamma$ | 20 |
| 6040 | 77.0 | 3.5 | 0.03 | | 0.35 | 0.23 | 0.03 | | remainder | $\alpha + \kappa$ | 50 |

TABLE 8

| | alloy composition (wt %) | | | | | | | | metal construction | |
|---|---|---|---|---|---|---|---|---|---|---|
| No. | Cu | Si | Pb | Se | P | Sb | As | Zn | phases | $\gamma + \kappa + \mu$ (%) |
| 6041 | 74.7 | 2.9 | 0.07 | 0.12 | 0.06 | | 0.03 | remainder | $\alpha + \gamma + \kappa$ | 25 |
| 6042 | 72.8 | 2.5 | 0.20 | 0.06 | | 0.03 | | remainder | $\alpha + \gamma$ | 20 |
| 6043 | 78.0 | 3.7 | 0.33 | 0.15 | | 0.02 | 0.10 | remainder | $\alpha + \kappa + \mu$ | 65 |
| 6044 | 74.0 | 2.8 | 0.12 | 0.05 | | | 0.08 | remainder | $\alpha + \gamma + \kappa$ | 25 |
| 6045 | 76.1 | 3.1 | 0.05 | 0.07 | 0.03 | 0.09 | 0.03 | remainder | $\alpha + \gamma + \kappa$ | 30 |

TABLE 10

| | alloy composition (wt %) | | | | | | metal construction | |
|---|---|---|---|---|---|---|---|---|
| No. | Cu | Si | Pb | Al | Mn | Zn | phases | $\gamma + \kappa + \mu$ (%) |
| 7018<br>7018a | 72.4 | 3.5 | 0.08 | 1.5 | 1.1 | remainder | $\alpha + \beta + \gamma + \kappa$ | 45 |
| 7019<br>7019a | 69.2 | 3.9 | 0.03 | 0.4 | 3.1 | remainder | $\alpha + \beta + \gamma$ | 25 |
| 7020<br>7020a | 76.6 | 4.3 | 0.14 | 2.3 | 1.9 | remainder | $\alpha + \beta + \gamma + \kappa$ | 65 |

TABLE 9

| Copper | alloy composition (wt %) | | | | | | Shapy Impact Value |
|---|---|---|---|---|---|---|---|
| Alloys No. | Cu | Si | Pb | Sn | P | Zn | (J/cm) |
| 1 | 75.1 | 2.8 | 0.06 | — | — | Remainder | 59.10 |
| 2 | 75.0 | 2.6 | 0.06 | 1.07 | — | Remainder | 12.20 |
| 3 | 75.3 | 2.7 | 0.05 | — | 0.11 | Remainder | 63.00 |

TABLE 9-continued

| Copper | alloy composition (wt %) | | | | | | Shapy Impact Value |
|---|---|---|---|---|---|---|---|
| Alloys No. | Cu | Si | Pb | Sn | P | Zn | (J/cm) |
| 4 | 76.7 | 3.0 | 0.06 | — | — | Remainder | 73.40 |
| 5 | 77.0 | 3.0 | 0.05 | 1.00 | — | Remainder | 9.90 |
| 6 | 77.1 | 3.1 | 0.05 | — | 0.10 | Remainder | 63.40 |

TABLE 11

| No. | alloy composition (wt %) Cu | Si | Pb | Al | P | Mn | Ni | Zn | metal construction phases | γ + κ + μ (%) |
|---|---|---|---|---|---|---|---|---|---|---|
| 7021 | 75.0 | 4.2 | 0.19 | 1.7 | | | 2.1 | remainder | α + β + γ + κ | 60 |
| 7021a | | | | | | | | | | |
| 7022 | 72.3 | 3.7 | 0.05 | 1.4 | | 1.1 | 0.8 | remainder | α + β + γ | 50 |
| 7022a | | | | | | | | | | |
| 7023 | 64.5 | 3.8 | 0.35 | 0.3 | | 2.0 | 2.3 | remainder | α + β + γ | 10 |
| 7023a | | | | | | | | | | |
| 7024 | 75.8 | 3.9 | 0.05 | 2.7 | 0.04 | 1.0 | | remainder | α + β + γ + κ | 45 |
| 7024a | | | | | | | | | | |
| 7025 | 70.1 | 3.5 | 0.06 | 1.2 | 0.23 | | 3.0 | remainder | α + β + γ | 30 |
| 7025a | | | | | | | | | | |
| 7026 | 67.2 | 2.8 | 0.22 | 1.8 | 0.14 | 2.2 | 0.9 | remainder | α + β + γ | 15 |
| 7026a | | | | | | | | | | |
| 7027 | 70.2 | 3.8 | 0.11 | | 0.03 | 3.2 | | remainder | α + β + γ | 25 |
| 7027a | | | | | | | | | | |
| 7028 | 75.9 | 4.4 | 0.03 | | 0.20 | | 1.1 | remainder | α + β + γ + κ | 65 |
| 7028a | | | | | | | | | | |
| 7029 | 66.0 | 3.0 | 0.18 | | 0.12 | 1.0 | 2.1 | remainder | α + β + γ | 10 |
| 7029a | | | | | | | | | | |

TABLE 12

| No. | alloy composition (wt %) Cu | Si | Pb | Al | P | Zn | metal construction phases | γ + κ + μ (%) |
|---|---|---|---|---|---|---|---|---|
| 8001 | 74.5 | 2.9 | 0.16 | 0.2 | 0.05 | remainder | α + γ + κ | 25 |
| 8002 | 76.0 | 2.7 | 0.03 | 1.2 | 0.21 | remainder | α + γ + κ | 30 |
| 8003 | 76.3 | 3.0 | 0.35 | 0.6 | 0.12 | remainder | α + γ + κ + μ | 40 |
| 8004 | 69.9 | 2.1 | 0.27 | 0.3 | 0.03 | remainder | α + β + γ | 10 |

TABLE 12-continued

| No. | alloy composition (wt %) Cu | Si | Pb | Al | P | Zn | metal construction phases | γ + κ + μ (%) |
|---|---|---|---|---|---|---|---|---|
| 8005 | 71.5 | 2.3 | 0.12 | 0.8 | 0.10 | remainder | α + β + γ | 15 |
| 8006 | 78.1 | 3.6 | 0.05 | 0.2 | 0.13 | remainder | α + κ | 55 |
| 8007 | 77.7 | 3.4 | 0.18 | 1.4 | 0.06 | remainder | α + γ + κ | 65 |
| 8008 | 77.5 | 3.5 | 0.03 | 0.9 | 0.15 | remainder | α + γ + κ + μ | 60 |

TABLE 13

| No. | alloy composition (wt %) Cu | Si | Pb | Al | P | Bi | Te | Se | Zn | metal construction phases | γ + κ + μ (%) |
|---|---|---|---|---|---|---|---|---|---|---|---|
| 9001 | 74.8 | 2.8 | 0.05 | 0.6 | 0.07 | 0.03 | | | remainder | α + γ + κ | 30 |
| 9002 | 76.6 | 2.9 | 0.12 | 0.9 | 0.03 | 0.32 | | | remainder | α + γ + κ | 40 |
| 9003 | 72.3 | 2.2 | 0.32 | 0.5 | 0.12 | | 0.25 | | remainder | α + β + γ | 20 |
| 9004 | 77.2 | 3.0 | 0.07 | 1.4 | 0.21 | | 0.05 | | remainder | α + γ + κ + μ | 45 |
| 9005 | 78.1 | 3.6 | 0.16 | 0.3 | 0.15 | | | 0.29 | remainder | α + κ + μ | 60 |
| 9006 | 74.5 | 2.6 | 0.05 | 0.6 | 0.08 | | | 0.07 | remainder | α + γ + κ | 25 |

TABLE 14

| | alloy composition (wt %) | | | | | | | | metal construction | |
|---|---|---|---|---|---|---|---|---|---|---|
| No. | Cu | Si | Pb | Al | P | Cr | Ti | Zn | phases | γ + κ + μ (%) |
| 10001 | 76.0 | 2.8 | 0.12 | 0.7 | 0.13 | | 0.21 | remainder | α + γ + κ + μ | 30 |
| 10002 | 75.0 | 3.0 | 0.03 | 0.2 | 0.05 | | 0.03 | remainder | α + γ + κ | 35 |
| 10003 | 78.3 | 3.4 | 0.06 | 1.3 | 0.20 | | 0.34 | remainder | α + κ + μ | 55 |
| 10004 | 69.6 | 2.1 | 0.25 | 0.8 | 0.03 | | 0.17 | remainder | α + β + γ | 25 |
| 10005 | 77.5 | 3.6 | 0.12 | 0.7 | 0.15 | 0.23 | | remainder | α + γ + κ | 60 |
| 10006 | 71.8 | 2.2 | 0.32 | 1.2 | 0.08 | 0.32 | | remainder | α + β + γ | 30 |
| 10007 | 74.7 | 2.7 | 0.10 | 0.6 | 0.10 | 0.03 | | remainder | α + γ + κ | 30 |
| 10008 | 75.4 | 2.9 | 0.03 | 0.3 | 0.06 | 0.12 | 0.08 | remainder | α + γ + κ + μ | 35 |

TABLE 15

| | alloy composition (wt %) | | | | | | | | | | | metal construction | |
|---|---|---|---|---|---|---|---|---|---|---|---|---|---|
| No. | Cu | Si | Pb | Al | Bi | Te | Se | P | Cr | Ti | Zn | phases | γ + κ + μ (%) |
| 11001 | 76.5 | 2.9 | 0.08 | 0.9 | 0.03 | | | 0.12 | 0.03 | | remainder | α + γ + κ | 40 |
| 11002 | 70.4 | 2.2 | 0.32 | 0.5 | 0.21 | | | 0.03 | 0.18 | | remainder | α + β + γ | 25 |
| 11003 | 78.2 | 3.5 | 0.16 | 1.3 | 0.35 | | | 0.20 | | 0.34 | remainder | α + κ + μ | 65 |
| 11004 | 73.9 | 2.7 | 0.03 | 0.3 | 0.11 | | | 0.06 | | 0.22 | remainder | α + γ | 30 |
| 11005 | 75.8 | 3.0 | 0.06 | 0.6 | 0.08 | | | 0.11 | 0.10 | 0.07 | remainder | α + γ + κ | 40 |
| 11006 | 71.6 | 2.1 | 0.24 | 1.0 | | 0.21 | | 0.04 | 0.32 | | remainder | α + β + γ | 30 |
| 11007 | 73.8 | 2.4 | 0.10 | 1.1 | | 0.04 | | 0.07 | | 0.03 | remainder | α + γ | 30 |
| 11008 | 75.5 | 3.0 | 0.13 | 0.2 | | 0.36 | | 0.12 | 0.06 | 0.14 | remainder | α + γ + κ | 35 |
| 11009 | 77.7 | 3.2 | 0.03 | 1.4 | | | 0.17 | 0.23 | 0.23 | | remainder | α + γ + κ | 50 |
| 11010 | 75.0 | 2.7 | 0.15 | 0.7 | | | 0.03 | 0.03 | | 0.12 | remainder | α + γ + κ | 35 |
| 11011 | 72.9 | 2.4 | 0.20 | 0.8 | | | 0.31 | 0.06 | 0.09 | 0.05 | remainder | α + γ | 30 |

TABLE 16

| | alloy composition (wt %) | | | | heat treatment | | metal construction | |
|---|---|---|---|---|---|---|---|---|
| No. | Cu | Si | Pb | Zn | temperature | time | phases | γ + κ + μ (%) |
| 12001 | 69.3 | 2.3 | 0.05 | remainder | 580° C. | 30 min. | α + γ + κ | 20 |
| 12002 | 69.3 | 2.3 | 0.05 | remainder | 450° C. | 2 hr. | α + γ + κ + μ | 20 |
| 12003 | 78.5 | 2.9 | 0.05 | remainder | 580° C. | 30 min. | α + γ + κ | 35 |
| 12004 | 78.5 | 2.9 | 0.05 | remainder | 450° C. | 2 hr. | α + γ + κ + μ | 35 |

TABLE 17

| | alloy composition (wt %) | | | | | | | | | metal construction |
|---|---|---|---|---|---|---|---|---|---|---|
| No. | Cu | Si | Pb | Sn | Al | Mn | Ni | Fe | Zn | phases |
| 13001 | 58.8 | | 3.1 | 0.2 | | | | 0.2 | remainder | α + β |
| 13001a | | | | | | | | | | |
| 13002 | 61.4 | | 3.0 | 0.2 | | | | 0.2 | remainder | α + β |
| 13002a | | | | | | | | | | |
| 13003 | 59.1 | | 2.0 | 0.2 | | | | 0.2 | remainder | α + β |
| 13003a | | | | | | | | | | |

TABLE 17-continued

| | alloy composition (wt %) | | | | | | | | | metal construction |
|---|---|---|---|---|---|---|---|---|---|---|
| No. | Cu | Si | Pb | Sn | Al | Mn | Ni | Fe | Zn | phases |
| 13004 | 69.2 | 1.2 | 0.1 | | | | | | remainder | α + β |
| 13004a | | | | | | | | | | |
| 13005 | remainder | | | | 9.8 | 1.1 | 1.2 | 3.9 | | α + β |
| 13005a | | | | | | | | | | |
| 13006 | 61.8 | | 0.1 | 1.0 | | | | | remainder | α + β + γ |
| 13006a | | | | | | | | | | |

TABLE 18

| No. | machinability: form of chippings | machinability: condition of cut surface | machinability: cutting force (N) | corrosion resistance: maximum depth of corrosion (μm) | hot workability: 700° C. deformability | mechanical properties: tensile strength (N/mm$^2$) | mechanical properties: elongation (%) | stress resistance corrosion cracking resistance |
|---|---|---|---|---|---|---|---|---|
| 1001 | ◎ | ○ | 117 | 160 | ○ | 533 | 35 | ○ |
| 1002 | ◎ | ○ | 114 | 170 | ○ | 520 | 32 | ○ |
| 1003 | ◎ | ○ | 119 | 140 | Δ | 575 | 36 | ○ |
| 1004 | ◎ | ○ | 118 | 220 | Δ | 490 | 30 | Δ |
| 1005 | ◎ | ○ | 114 | 170 | ○ | 546 | 34 | ○ |
| 1006 | ◎ | Δ | 127 | 170 | Δ | 515 | 44 | ○ |

TABLE 19

| No. | machinability: form of chippings | machinability: condition of cut surface | machinability: cutting force (N) | corrosion resistance: maximum depth of corrosion (μm) | hot workability: 700° C. deformability | mechanical properties: tensile strength (N/mm$^2$) | mechanical properties: elongation (%) | stress resistance corrosion cracking resistance |
|---|---|---|---|---|---|---|---|---|
| 2001 | ◎ | ○ | 116 | 180 | ○ | 510 | 33 | ○ |
| 2002 | ◎ | ○ | 115 | 230 | Δ | 475 | 28 | Δ |
| 2003 | ◎ | ○ | 115 | 160 | Δ | 540 | 32 | ○ |
| 2004 | ◎ | ○ | 117 | 150 | Δ | 576 | 35 | ○ |
| 2005 | ◎ | ○ | 116 | 140 | Δ | 543 | 37 | ○ |
| 2006 | ◎ | ○ | 114 | 180 | Δ | 502 | 32 | ○ |

TABLE 20

| No. | machinability: form of chippings | machinability: condition of cut surface | machinability: cutting force (N) | corrosion resistance: maximum depth of corrosion (μm) | hot workability: 700° C. deformability | mechanical properties: tensile strength (N/mm$^2$) | mechanical properties: elongation (%) | stress resistance corrosion cracking resistance |
|---|---|---|---|---|---|---|---|---|
| 3003 | ◎ | ○ | 119 | 110 | Δ | 565 | 34 | ○ |
| 3004 | ◎ | ○ | 118 | 140 | ○ | 532 | 35 | ○ |
| 3006 | ◎ | ○ | 115 | 30 | ○ | 538 | 34 | ○ |
| 3007 | ◎ | ○ | 117 | <5 | Δ | 562 | 36 | ○ |
| 3009 | ◎ | ○ | 118 | <5 | Δ | 518 | 30 | ○ |

TABLE 21

| No. | machinability: form of chippings | machinability: condition of cut surface | machinability: cutting force (N) | corrosion resistance: maximum depth of corrosion (μm) | hot workability: 700° C. deformability | mechanical properties: tensile strength (N/mm$^2$) | mechanical properties: elongation (%) | stress resistance corrosion cracking resistance |
|---|---|---|---|---|---|---|---|---|
| 4002 | ◎ | ○ | 116 | 120 | ○ | 547 | 33 | ○ |
| 4004 | ○ | ○ | 113 | 30 | Δ | 550 | 31 | ○ |
| 4006 | ◎ | ○ | 118 | <5 | Δ | 542 | 30 | ○ |
| 4009 | ◎ | ○ | 117 | 110 | Δ | 572 | 36 | ○ |
| 4010 | ◎ | ○ | 115 | 10 | ○ | 524 | 33 | ○ |
| 4012 | ◎ | ○ | 114 | 20 | ○ | 575 | 34 | ○ |
| 4016 | ◎ | ○ | 116 | 130 | Δ | 539 | 32 | ○ |
| 4018 | ◎ | ○ | 115 | <5 | ○ | 506 | 30 | ○ |
| 4020 | ◎ | ○ | 115 | 20 | Δ | 548 | 32 | ○ |

TABLE 22

| No. | machinability: form of chippings | machinability: condition of cut surface | machinability: cutting force (N) | corrosion resistance: maximum depth of corrosion (μm) | hot: workability 700° C. deformability | mechanical properties: tensile strength (N/mm$^2$) | mechanical properties: elongation (%) | stress resistance corrosion cracking resistance |
|---|---|---|---|---|---|---|---|---|
| 5003 | ◎ | ○ | 117 | <5 | ○ | 510 | 33 | ○ |
| 5004 | ◎ | ○ | 117 | <5 | Δ | 547 | 42 | ○ |
| 5005 | ◎ | ○ | 115 | <5 | ○ | 533 | 34 | ○ |
| 5006 | ◎ | ○ | 116 | <5 | ○ | 470 | 30 | Δ |
| 5013 | ◎ | ○ | 116 | <5 | ○ | 504 | 33 | ○ |
| 5014 | ○ | ○ | 114 | <5 | ○ | 536 | 35 | ○ |
| 5015 | ◎ | ○ | 117 | <5 | ○ | 488 | 31 | ○ |
| 5016 | ◎ | ○ | 116 | <5 | ○ | 510 | 37 | ○ |

TABLE 23

| No. | machinability: form of chippings | machinability: condition of cut surface | machinability: cutting force (N) | corrosion resistance: maximum depth of corrosion (μm) | hot: workability 700° C. deformability | mechanical properties: tensile strength (N/mm$^2$) | mechanical properties: elongation (%) | stress resistance corrosion cracking resistance |
|---|---|---|---|---|---|---|---|---|
| 6009 | ◎ | ○ | 115 | <5 | Δ | 546 | 40 | ○ |
| 6010 | ◎ | ○ | 116 | <5 | ○ | 507 | 30 | ○ |
| 6011 | ○ | ○ | 113 | <5 | Δ | 520 | 30 | ○ |
| 6012 | ◎ | ○ | 115 | <5 | Δ | 488 | 29 | Δ |
| 6013 | ○ | ○ | 114 | <5 | ○ | 531 | 32 | ○ |
| 6014 | ◎ | ○ | 114 | <5 | Δ | 564 | 31 | ○ |
| 6015 | ◎ | ○ | 115 | 20 | ○ | 525 | 34 | ○ |

TABLE 24

| No. | machinability: form of chippings | machinability: condition of cut surface | machinability: cutting force (N) | corrosion resistance: maximum depth of corrosion (μm) | hot: workability 700° C. deformability | mechanical properties: tensile strength (N/mm$^2$) | mechanical properties: elongation (%) | stress resistance corrosion cracking resistance |
|---|---|---|---|---|---|---|---|---|
| 6024 | ◎ | ○ | 116 | <5 | ○ | 515 | 33 | ○ |
| 6025 | ◎ | ○ | 117 | <5 | Δ | 575 | 35 | ○ |
| 6026 | ◎ | ○ | 114 | <5 | ○ | 524 | 32 | ○ |
| 6027 | ◎ | ○ | 119 | <5 | ○ | 503 | 34 | ○ |
| 6028 | ◎ | ○ | 117 | <5 | ○ | 510 | 33 | ○ |
| 6029 | ○ | ○ | 114 | <5 | Δ | 522 | 30 | ○ |
| 6030 | ◎ | ○ | 118 | 40 | ○ | 546 | 37 | ○ |
| 6039 | ◎ | ○ | 117 | 20 | ○ | 497 | 31 | ○ |
| 6040 | ◎ | ○ | 118 | <5 | Δ | 574 | 35 | ○ |

TABLE 25

| No. | machinability: form of chippings | machinability: condition of cut surface | machinability: cutting force (N) | corrosion resistance: maximum depth of corrosion (μm) | hot: workability 700° C. deformability | mechanical properties: tensile strength (N/mm$^2$) | mechanical properties: elongation (%) | stress resistance corrosion cracking resistance |
|---|---|---|---|---|---|---|---|---|
| 6041 | ◎ | ○ | 115 | <5 | ○ | 520 | 34 | ○ |
| 6042 | ◎ | ○ | 117 | 20 | Δ | 501 | 31 | ○ |
| 6043 | ◎ | ○ | 118 | <5 | Δ | 585 | 32 | ○ |
| 6044 | ◎ | ○ | 116 | <5 | ○ | 516 | 32 | ○ |
| 6045 | ◎ | ○ | 116 | <5 | ○ | 538 | 35 | ○ |

TABLE 26

| No. | machinability: form of chippings | machinability: condition of cut surface | machinability: cutting force (N) | hot workability 700° C. deformability | mechanical properties: tensile strength (N/mm$^2$) | mechanical properties: elongation (%) |
|---|---|---|---|---|---|---|
| 7018 | ◎ | ○ | 128 | ○ | 710 | 21 |
| 7019 | ◎ | ○ | 128 | ○ | 746 | 20 |
| 7020 | ◎ | ○ | 126 | ○ | 802 | 19 |

TABLE 27

| No. | machinability: form of chippings | machinability: condition of cut surface | machinability: cutting force (N) | hot workability 700° C. deformability | mechanical properties: tensile strength (N/mm$^2$) | mechanical properties: elongation (%) |
|---|---|---|---|---|---|---|
| 7021 | ◎ | ○ | 126 | ○ | 792 | 19 |
| 7022 | ◎ | ○ | 128 | ○ | 762 | 20 |
| 7023 | ◎ | ○ | 129 | ○ | 725 | 17 |
| 7024 | ◎ | ○ | 128 | ○ | 744 | 21 |
| 7025 | ◎ | ○ | 130 | ○ | 750 | 20 |
| 7026 | Δ | ○ | 132 | ○ | 671 | 23 |
| 7027 | ◎ | ○ | 128 | ○ | 740 | 23 |
| 7028 | ◎ | ○ | 133 | ○ | 763 | 22 |
| 7029 | Δ | ○ | 129 | ○ | 647 | 24 |

TABLE 28

| No. | machinability: form of chippings | machinability: condition of cut surface | machinability: cutting force (N) | corrosion resistance: maximum depth of corrosion (μm) | hot workability 700° C. deformability | mechanical properties: tensile strength (N/mm$^2$) | mechanical properties: elongation (%) | stress resistance corrosion cracking resistance | high-temperature oxidation increase in weight by oxidation (mg/10 cm$^2$) |
|---|---|---|---|---|---|---|---|---|---|
| 8001 | ◎ | ○ | 114 | <5 | ○ | 528 | 35 | ○ | 0.5 |
| 8002 | ◎ | ○ | 116 | <5 | ○ | 545 | 37 | ○ | 0.2 |
| 8003 | ○ | ○ | 113 | <5 | Δ | 547 | 34 | ○ | 0.4 |
| 8004 | ◎ | ○ | 116 | 40 | ○ | 482 | 30 | Δ | 0.5 |
| 8005 | ◎ | ○ | 117 | <5 | ○ | 502 | 32 | ○ | 0.3 |
| 8006 | ◎ | ○ | 117 | <5 | Δ | 570 | 36 | ○ | 0.4 |
| 8007 | ◎ | ○ | 117 | <5 | ○ | 575 | 33 | ○ | 0.2 |
| 8008 | ◎ | ○ | 118 | <5 | ○ | 552 | 36 | ○ | 0.3 |

TABLE 29

| No. | machinability: form of chippings | machinability: condition of cut surface | machinability: cutting force (N) | corrosion resistance: maximum depth of corrosion (μm) | hot workability 700° C. deformability | mechanical properties: tensile strength (N/mm$^2$) | mechanical properties: elongation (%) | stress resistance corrosion cracking resistance | high-temperature oxidation increase in weight by oxidation (mg/10 cm$^2$) |
|---|---|---|---|---|---|---|---|---|---|
| 9001 | ◎ | ○ | 115 | <5 | ○ | 526 | 33 | ○ | 0.4 |
| 9002 | ○ | ○ | 113 | 20 | Δ | 543 | 30 | ○ | 0.3 |
| 9003 | ○ | ○ | 115 | <5 | Δ | 508 | 28 | ○ | 0.4 |
| 9004 | ◎ | ○ | 117 | <5 | ○ | 567 | 37 | ○ | 0.2 |
| 9005 | ◎ | ○ | 115 | <5 | Δ | 571 | 33 | ○ | 0.4 |
| 9006 | ◎ | ○ | 116 | <5 | ○ | 513 | 35 | ○ | 0.4 |

TABLE 30

| No. | machinability: form of chippings | machinability: condition of cut surface | machinability: cutting force (N) | corrosion resistance: maximum depth of corrosion (μm) | hot workability 700° C. deformability | mechanical properties: tensile strength (N/mm$^2$) | mechanical properties: elongation (%) | stress resistance corrosion cracking resistance | high-temperature oxidation increase in weight by oxidation (mg/10 cm$^2$) |
|---|---|---|---|---|---|---|---|---|---|
| 10001 | ◎ | ○ | 115 | <5 | ○ | 534 | 38 | ○ | 0.1 |
| 10002 | ◎ | ○ | 116 | 10 | ○ | 538 | 36 | ○ | 0.4 |
| 10003 | ◎ | ○ | 117 | <5 | ○ | 563 | 39 | ○ | <0.1 |
| 10004 | ◎ | ○ | 115 | <5 | ○ | 505 | 30 | Δ | 0.2 |
| 10005 | ◎ | ○ | 116 | <5 | Δ | 572 | 38 | ○ | 0.2 |
| 10006 | ◎ | ○ | 115 | <5 | ○ | 514 | 28 | ○ | 0.1 |
| 10007 | ◎ | ○ | 114 | <5 | ○ | 525 | 34 | ○ | 0.2 |
| 10008 | ◎ | ○ | 115 | 20 | ○ | 530 | 36 | ○ | 0.2 |

TABLE 31

| No. | machinability: form of chippings | machinability: condition of cut surface | machinability: cutting force (N) | corrosion resistance: maximum depth of corrosion (μm) | hot workability 700° C. deformability | mechanical properties: tensile strength (N/mm$^2$) | mechanical properties: elongation (%) | stress resistance corrosion cracking resistance | high-temperature oxidation increase in weight by oxidation (mg/10 cm$^2$) |
|---|---|---|---|---|---|---|---|---|---|
| 11001 | ◎ | ○ | 115 | <5 | ○ | 552 | 35 | ○ | 0.2 |
| 11002 | ◎ | ○ | 116 | 30 | Δ | 504 | 28 | Δ | 0.2 |
| 11003 | ◎ | ○ | 115 | <5 | Δ | 598 | 34 | ○ | <0.1 |
| 11004 | ◎ | ○ | 116 | <5 | ○ | 515 | 32 | ○ | 0.1 |
| 11005 | ○ | ○ | 113 | <5 | ○ | 540 | 35 | ○ | 0.1 |
| 11006 | ◎ | ○ | 116 | 20 | Δ | 487 | 31 | ○ | 0.1 |
| 11007 | ◎ | ○ | 117 | <5 | ○ | 524 | 32 | ○ | 0.1 |
| 11008 | ○ | ○ | 114 | <5 | ○ | 537 | 30 | ○ | 0.2 |
| 11009 | ◎ | ○ | 115 | <5 | Δ | 569 | 35 | ○ | 0.1 |
| 11010 | ◎ | ○ | 115 | 10 | ○ | 531 | 32 | ○ | 0.1 |
| 11011 | ◎ | ○ | 116 | <5 | ○ | 510 | 29 | ○ | 0.1 |

TABLE 32

| No. | machinability: form of chippings | machinability: condition of cut surface | machinability: cutting force (N) | corrosion resistance: maximum depth of corrosion (μm) | hot workability 700° C. deformability | mechanical properties: tensile strength (N/mm$^2$) | mechanical properties: elongation (%) | stress resistance corrosion cracking resistance |
|---|---|---|---|---|---|---|---|---|
| 12001 | ◎ | ○ | 122 | 210 | ○ | 486 | 36 | ○ |
| 12002 | ◎ | ○ | 119 | 200 | ○ | 490 | 35 | ○ |
| 12203 | ◎ | ○ | 120 | 160 | Δ | 501 | 40 | ○ |
| 12004 | ◎ | ○ | 119 | 160 | Δ | 505 | 41 | ○ |

TABLE 33

| No. | machinability: form of chippings | machinability: condition of cut surface | machinability: cutting force (N) | corrosion resistance: maximum depth of corrosion (μm) | hot workability 700° C. deformability | mechanical properties: tensile strength (N/mm$^2$) | mechanical properties: elongation (%) | stress resistance corrosion cracking resistance | high-temperature oxidation increase in weight by oxidation (mg/10 cm$^2$) |
|---|---|---|---|---|---|---|---|---|---|
| 13001 | ○ | ○ | 103 | 1100 | Δ | 408 | 37 | X X | 1.8 |
| 13002 | ○ | ○ | 101 | 1000 | X | 387 | 39 | X X | 1.7 |
| 13003 | ○ | Δ | 112 | 1050 | ○ | 414 | 38 | X X | 1.7 |
| 13004 | X | ○ | 223 | 900 | ○ | 438 | 38 | X | 1.2 |
| 13005 | X | ○ | 178 | 350 | Δ | 735 | 28 | ○ | 0.2 |
| 13006 | X | ○ | 217 | 600 | ○ | 425 | 39 | X | 1.8 |

TABLE 34

| No. | wear resistance weight loss by wear (mg/100000 rot.) |
|---|---|
| 7018a | 1.9 |
| 7019a | 1.1 |
| 7020a | 1.4 |

TABLE 35

| No. | wear resistance weight loss by wear (mg/100000 rot.) |
|---|---|
| 7021a | 1.5 |
| 7022a | 1.4 |
| 7023a | 0.9 |
| 7024a | 2 |
| 7025a | 1.2 |
| 7026a | 1.2 |
| 7027a | 1.1 |
| 7028a | 2.1 |
| 7029a | 1.5 |

TABLE 36

| No. | wear resistance weight loss by wear (mg/100000 rot.) |
|---|---|
| 13001a | 500 |
| 13002a | 620 |
| 13003a | 520 |
| 13004a | 450 |
| 13005a | 25 |
| 13006a | 600 |

What is claimed is:

1. A free-cutting copper alloy, consisting essentially of 69 to 79 percent, by weight, of copper; 2.0 to 4.0 percent, by weight, of silicon; 0.02 to 0.4 percent, by weight, of lead; and a remaining percentage, by weight, of zinc, wherein the percent by weight of copper and silicon in the copper alloy satisfy the relationship $$60 \leqq X-3Y \leqq 70,$$

wherein

X is the percent, by weight, of copper, and

Y is the percent, by weight, of silicon; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

2. A free-cutting copper alloy, consisting essentially of 69 to 79 percent, by weight, of copper; 2.0 to 4.0 percent, by weight, of silicon; 0.02 to 0.4 percent, by weight, of lead; one element selected from among 0.02 to 0.4 percent, by weight, of bismuth, 0.02 to 0.4 percent, by weight, of tellurium, and 0.02 to 0.4 percent, by weight, of selenium; and a remaining percentage, by weight, of zinc, wherein the percent by weight of copper and silicon in the copper alloy satisfy the relationship $$60 \leqq X-3Y \leqq 70,$$

wherein

X is the percent, by weight, of copper, and

Y is the percent, by weight, of silicon; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

3. A free-cutting copper alloy, consisting essentially of 70 to 80 percent, by weight, of copper; 1.8 to 3.5 percent, by weight, of silicon; 0.02 to 0.4 percent, by weight, of lead; at least one element selected from among 1.0 to 3.5 percent, by weight, of aluminum, and 0.02 to 0.25 percent, by weight, of phosphorus; and a remaining percentage, by weight, of zinc, wherein the percent by weight of copper, silicon, aluminum and phosphorus in the copper alloy satisfy the relationship $$60 \leqq X-3Y+aZ+bW \leqq 70,$$

wherein

X is the percent, by weight, of copper,

Y is the percent, by weight, of silicon,

Z is the percent, by weight, of aluminum,

W is the percent, by weight, of phosphorus, a is −2, and b is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

4. A free-cutting copper alloy, consisting essentially of 70 to 80 percent, by weight, of copper; 1.8 to 3.5 percent, by weight, of silicon; 0.02 to 0.4 percent, by weight, of lead; at least one element selected from among 1.0 to 3.5 percent, by weight, of aluminum, and 0.02 to 0.25 percent, by weight, of phosphorus; one element selected from among 0.02 to 0.4 percent, by weight, of bismuth, 0.02 to 0.4 percent, by weight, of tellurium, and 0.02 to 0.4 percent, by weight, of selenium; and a remaining percentage, by weight, of zinc, wherein the percent by weight of copper, silicon, aluminum and phosphorus in the copper alloy satisfy the relationship $$60 \leqq X-3Y+aZ+bW \leqq 70,$$

wherein

X is the percent, by weight, of copper,

Y is the percent, by weight, of silicon,

Z is the percent, by weight, of aluminum,

W is the percent, by weight, of phosphorus, a is −2, and b is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

5. A free-cutting copper alloy, consisting essentially of 69 to 79 percent, by weight, of copper; 2.0 to 4.0 percent, by weight, of silicon; 0.02 to 0.4 percent, by weight, of lead; at least one element selected from among 0.02 to 0.25 percent, by weight, of phosphorus, 0.02 to 0.15 percent, by weight, of antimony, and 0.02 to 0.15 percent, by weight, of arsenic; and a remaining percentage, by weight, of zinc, wherein the percent by weight of copper, silicon and phosphorous in the copper alloy satisfy the relationship $$60 \leqq X-3Y+aZ \leqq 70,$$

wherein

X is the percent, by weight, of copper,

Y is the percent, by weight, of silicon,

Z is the percent, by weight, of phosphorous, and a is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

6. A free-cutting copper alloy, consisting essentially of 69 to 79 percent, by weight, of copper; 2.0 to 4.0 percent, by weight, of silicon; 0.02 to 0.4 percent, by weight, of lead; at least one element selected from among 0.02 to 0.25 percent, by weight, of phosphorus, 0.02 to 0.15 percent, by weight, of antimony, and 0.02 to 0.15 percent, by weight, of arsenic; one element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc, wherein the percent by weight of copper, silicon and phosphorous in the copper alloy satisfy the relationship $$60 \leqq X-3Y+aZ \leqq 70,$$

wherein

X is the percent, by weight, of copper,

Y is the percent, by weight, of silicon,

Z is the percent, by weight, of phosphorous, and a is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

7. A free-cutting copper alloy, consisting essentially of 62 to 78 percent, by weight, of copper; 2.5 to 4.5 percent, by weight, of silicon; 0.02 to 0.4 percent, by weight, of lead; at least one element selected from among 0.2 to 2.5 percent, by weight, of aluminum, and 0.02 to 0.25 percent, by weight, of phosphorus; and at least one element selected from among 0.7 to 3.5 percent, by weight, of manganese and 0.7 to 3.5 percent, by weight, of nickel; and a remaining percentage, by weight, of zinc, wherein the percent by weight of copper, silicon, aluminum, phosphorous, manganese, and nickel in the copper alloy satisfy the relationship $$60 \leqq X-3Y+aZ+bW+cV+dU \leqq 70,$$

wherein

X is the percent, by weight, of copper,

Y is the percent, by weight, of silicon,

Z is the percent, by weight, of aluminum,

W is the percent, by weight, of phosphorous,

V is the percent, by weight, of manganese,

U is the percent, by weight, of nickel, a is −2, b is −3, c is 2.5, and d is 2.5, and the percent by weight of silicon, manganese and nickel satisfy the relationship $$0.7 \leqq Y/(V+U) \leqq 6; \text{ and}$$

the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

8. A free-cutting copper alloy, consisting essentially of 69 to 79 percent, by weight, of copper; 2.0 to 4.0 percent, by weight, of silicon; 0.02 to 0.4 percent, by weight, of lead; 0.1 to 1.5 percent, by weight, of aluminum; and 0.02 to 0.25 percent, by weight, of phosphorus; and a remaining percentage, by weight, of zinc, wherein the percent by weight of copper, silicon, aluminum, and phosphorous in the copper alloy satisfy the relationship $$60 \leqq X-3Y+aZ+bW \leqq 70,$$

wherein

X is the percent, by weight, of copper,

Y is the percent, by weight, of silicon,

Z is the percent, by weight, of aluminum,

W is the percent, by weight, of phosphorous, a is −2, and b is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

9. A free-cutting copper alloy, consisting essentially of 69 to 79 percent, by weight, of copper; 2.0 to 4.0 percent, by weight, of silicon; 0.02 to 0.4 percent, by weight, of lead; 0.1 to 1.5 percent, by weight, of aluminum; 0.02 to 0.25 percent by weight, of phosphorus; one element selected from among 0.02 to 0.4 percent, by weight, of bismuth, 0.02 to 0.4 percent, by weight, of tellurium, and 0.02 to 0.4 percent, by weight, of selenium; and a remaining percentage, by weight, of zinc, wherein the percent by weight of copper, silicon, aluminum, and phosphorous in the copper alloy satisfy the relationship $$60 \leqq X-3Y+aZ+bW \leqq 70,$$

wherein

X is the percent, by weight, of copper,

Y is the percent, by weight, of silicon,

Z is the percent, by weight, of aluminum,

W is the percent, by weight, of phosphorous, a is −2, and b is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

10. A free-cutting copper alloy, consisting essentially of 69 to 79 percent, by weight, of copper; 2.0 to 4.0 percent, by weight, of silicon; 0.02 to 0.4 percent, by weight, of lead; 0.1 to 1.5 percent, by weight, of aluminum; 0.02 to 0.25 percent, by weight, of phosphorus; at least one element selected from among 0.02 to 0.4 percent, by weight, of chromium and 0.02 to 0.4 percent, by weight, of titanium; and a remaining percentage, by weight, of zinc, wherein the percent by weight of copper, silicon, aluminum, phosphorous and chromium in the copper alloy satisfy the relationship $$60 \leqq X-3Y+aZ+bW+cV \leqq 70,$$

wherein

X is the percent, by weight, of copper,

Y is the percent, by weight, of silicon,

Z is the percent, by weight, of aluminum,

W is the percent, by weight, of phosphorous,

V is the percent, by weight, of chromium, a is −2, b is −3, and c is 2; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

11. A free-cutting copper alloy, consisting essentially of 69 to 79 percent, by weight, of copper; 2.0 to 4.0 percent, by weight, of silicon; 0.02 to 0.4 percent, by weight, of lead; 0.1 to 1.5 percent, by weight, of aluminum; 0.02 to 0.25 percent, by weight, of phosphorus; at least one element selected from among 0.02 to 0.4 percent, by weight, of chromium and 0.02 to 0.4 percent by weight of titanium; one element selected from among 0.02 to 0.4 percent, by weight, of bismuth, 0.02 to 0.4 percent, by weight, of tellurium and 0.02 to 0.4 percent, by weight, of selenium; and a remaining percentage, by weight, of zinc, wherein the percent by weight of copper, silicon, aluminum, phosphorous and chromium in the copper alloy satisfy the relationship $$60 \leqq X-3Y+aZ+bW+cV \leqq 70,$$

wherein

X is the percent, by weight, of copper,
Y is the percent, by weight, of silicon,
Z is the percent, by weight, of aluminum,
W is the percent, by weight, of phosphorous,
V is the percent, by weight, of chromium,
a is −2,
b is −3, and
c is 2; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

12. A free-cutting copper alloy which comprises 69 to 79 percent, by weight, of copper; 2.0 to 4.0 percent, by weight, of silicon; 0.02 to 0.4 percent, by weight, of lead; optionally, at least one element selected from among 0.02 to 0.25 percent, by weight, of phosphorus, 0.02 to 0.15 percent, by weight, of antimony, and 0.02 to 0.15 percent, by weight, of arsenic; optionally, one element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc, wherein the percent by weight of copper, silicon and phosphorous in the copper alloy satisfy the relationship $$60 \leqq X-3Y+aZ \leqq 70,$$

wherein

X is the percent, by weight, of copper,
Y is the percent, by weight, of silicon,
Z is the percent, by weight, of phosphorous, and
a is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

13. A free-cutting copper alloy which comprises 70 to 80 percent, by weight, of copper; 1.8 to 3.5 percent, by weight, of silicon; 0.02 to 0.4 percent, by weight, of lead; optionally, at least one element selected from among 1.0 to 3.5 percent, by weight, of aluminum, and 0.02 to 0.25 percent, by weight, of phosphorus; optionally, one element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc, wherein the percent by weight of copper, silicon, aluminum and phosphorus in the copper alloy satisfy the relationship $$60 \leqq X-3Y+aZ+bW \leqq 70,$$

wherein

X is the percent, by weight, of copper,
Y is the percent, by weight, of silicon,
Z is the percent, by weight, of aluminum,
W is the percent, by weight, of phosphorus,
a is −2, and
b is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

14. A free-cutting copper alloy which comprises 69 to 79 percent, by weight, of copper; 2.0 to 4.0 percent, by weight, of silicon; 0.02 to 0.4 percent, by weight, of lead; 0.1 to 1.5 percent, by weight, of aluminum; 0.02 to 0.25 percent, by weight, of phosphorus; optionally, at least one element selected from among 0.02 to 0.4 percent, by weight, of chromium and 0.02 to 0.4 percent by weight of titanium; optionally, one element selected from among 0.02 to 0.4 percent, by weight, of bismuth, 0.02 to 0.4 percent, by weight, of tellurium and 0.02 to 0.4 percent, by weight, of selenium; and the remaining percent, by weight, of zinc, wherein the percent by weight of copper, silicon, aluminum, phosphorous and chromium in the copper alloy satisfy the relationship $$60 \leqq X-3Y+aZ+bW+cV \leqq 70,$$

wherein

X is the percent, by weight, of copper,
Y is the percent, by weight, of silicon,
Z is the percent, by weight, of aluminum,
W is the percent, by weight, of phosphorous,
V is the percent, by weight, of chromium,
a is −2,
b is −3, and
c is 2; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

* * * * *